United States Patent [19]

Carroll et al.

[11] 4,320,837

[45] Mar. 23, 1982

[54] NESTING AND STACKING CONTAINER

[75] Inventors: James C. Carroll; Lewis T. Johnson, both of Hopkinsville, Ky.

[73] Assignee: Phillips Petroleum Company, Bartlesville, Okla.

[21] Appl. No.: 200,721

[22] Filed: Oct. 27, 1980

Related U.S. Application Data

[63] Continuation of Ser. No. 944,813, Sep. 22, 1978, abandoned.

[51] Int. Cl.[3] ..... B65D 21/04

[52] U.S. Cl. ..... 206/505; 206/507

[58] Field of Search ..... 206/505, 506, 507, 518, 206/519, 520, 513

[56] References Cited

U.S. PATENT DOCUMENTS

| | | | |
|---|---|---|---|
| 2,252,964 | 8/1941 | Faulkner . | |
| 2,931,535 | 4/1960 | Lockwood . | |
| 3,113,964 | 12/1963 | Frater . | |
| 3,219,232 | 11/1965 | Wilson . | |
| 3,250,677 | 9/1965 | Stoner | 206/519 |
| 3,398,840 | 8/1968 | Wilson . | |
| 3,401,862 | 9/1968 | Wanderer | 206/519 |
| 3,404,804 | 10/1968 | Frater et al. . | |
| 3,481,507 | 12/1969 | Sanders . | |
| 3,675,815 | 7/1972 | Rehrig | 206/507 |
| 3,825,114 | 7/1974 | Johnson | 206/507 |
| 3,934,724 | 1/1976 | Johnson | 206/507 |
| 4,015,712 | 4/1977 | Wandenster | 206/507 |
| 4,102,453 | 7/1978 | Carroll et al. | 206/507 |

*Primary Examiner*—George E. Lowrance

[57] ABSTRACT

A multi-position container adapted to nest within a like-oriented lower container of like construction, and also adapted to stack on a said lower container in a "high-stack" position without rotating the upper container with respect to the lower container. In a preferred embodiment a said upper container can also be stacked within a said lower container at an "intermediate-stack" position without rotating the upper container with respect to the lower container. Thus, in the preferred embodiments, a three-position container is provided. In yet another embodiment an upper container can be stacked on a lower container in a high-stack position and in an intermediate-stack position, which also becomes the nest position in this embodiment.

14 Claims, 38 Drawing Figures

NESTING AND STACKING CONTAINER

CROSS-REFERENCE TO RELATED APPLICATION

This application is a continuation of co-pending application, Ser. No. 944,813 filed Sept. 22, 1978 by the present inventors now abandoned.

BACKGROUND OF THE INVENTION

This application relates to a multi-position container.

Nesting and stacking containers, e.g., containers so constructed that an upper container will nest within or stack on a lower container of like construction when said upper container is rotated to a different orientation are well known in the art. Such containers have great utility in various industries, e.g., the baking industry. However, one frequently troublesome and undesirable problem with such containers is the different orientation required when one container is stacked on, or nested within, a like lower container. In manual handling the operator will frequently misorient the container being nested or stacked, resulting in increased handling of the container and loss of time. Moreover, automation of the handling of such containers is difficult. In recent times it has become increasingly desirable to have a container which will nest within, or stack on, a like container of like orientation, i.e., without rotating the upper container with respect to the lower container. Only a few such containers are known to the art and/or are commercially available. It is even more desirable to have a container which will nest within a like-oriented container of like construction, and which can also be stacked with a like container at two or more elevations without the necessity of rotating the upper container with respect to the lower container. Even fewer of such containers are known to the art and/or are commercially available. Insofar as is presently known those which are commercially available tend to be of complicated and/or impractical design.

It is also desirable that containers of the type considered herein be of light weight and sturdy construction and be capable of being economically fabricated from moldable materials such as plastics and metals. For example, it is desirable that such containers be provided with maximum vertical strength in the wall portions (commensurate with the weight of the container) so that when a number of filled containers are stacked vertically the lowermost containers in the stack will not be collapsed or become warped.

It is also desirable that said containers be provided with convenient handle means for manual handling. Even though mechanical handling of such containers, and particularly the palletizing of groups of such containers, is being more and more widely employed, there are still steps in said mechanical handling operations where the containers must be handled manually. It is further desirable that the containers be provided with substantially flat walls, if possible, to facilitate mechanical handling, such as on conveyor belts, etc.

Attaining all of the above advantages or features in one container has been extremely difficult. The side and end walls of prior art containers have been provided with corrugations or convolutions so as to provide increased vertical strength thereto. However, this has created problems in the handling of said containers due to interlocking of said corrugations or convolutions when the ends of containers encounter one another in use, as on conveyor belts or when placed side by side. Containers in the past have been commonly provided with handles by providing an opening in opposed walls adjacent the top thereof. Such handle openings weaken said walls. Furthermore, such openings provide places where the contents of the container can be damaged by the fingers of the person handling the container.

The above problems have been solved, in accordance with U.S. Pat. No. 4,102,453, by providing a nesting and stacking container which is not subject to the above difficulties or limitations. The improved containers of said patent are provided with an improved wall structure which makes it possible to nest an upper container within a like-oriented, lower container of like construction, and also to stack a said upper container on a said lower container in a "high-stack" position without rotating said upper container with respect to the lower container. In a preferred embodiment, said upper container can also be stacked within a like lower container at an "intermediate-stack" position without rotating the upper container with respect to the lower container. Thus, the containers of said patent can be employed in handling a greater variety of products in a more economical and efficient manner. For example, in the handling of bakery products, the containers of the invention can be employed in a "high-stack" position when filled with relatively high products, e.g., cakes or loaves of bread, or can be employed in a "intermediate-stack" position when filled with products having a low height, e.g., rolls, pies, etc. Thus, a bakery operator can employ containers of the patent in multiple uses and eliminate the need for stocking several different types of containers for different types of products.

Thus, according to said U.S. Pat. No. 4,102,453, there is provided a generally rectangular nesting and stacking container comprising a generally, horizontally-disposed bottom, and opposed first and second side wall structures projecting upwardly from opposed first and second sides of the bottom, with each of the wall structures comprising, in combination: a plurality of spaced apart stacking feet disposed on the side of the bottom; an upper rail member spaced from and disposed generally vertically above the side of the bottom; a plurality of spaced apart stacking saddles disposed on the inner surface of the upper rail member and in vertical alignment with the stacking feet; and a plurality of spaced apart and like inclined bar members extending upwardly, in one direction only, between the side of the bottom and the inner surface of the rail member and in the same vertical plane as the stacking feet and the stacking saddles; with the stacking feet, the stacking saddles, and the inclined bar members in each wall structure being so arranged with respect to each other that an upper container will (a) stack vertically on a like-oriented lower container of like construction when at least some of the stacking feet of the upper container are in vertical alignment with and in register with at least some of the stacking saddles in the corresponding wall structure of the lower container, and (b) nest vertically within the lower container when the upper container is moved diagonally downward into said lower container to place the bar members of the upper container parallel to the bar members in the corresponding wall structure of the lower container, with the stacking feet of the upper container out of register with the stacking saddles of the lower container.

In the use of production models of the container of said U.S. Pat. No. 4,102,453, several problems were encountered.

First, it was found that sharp edges on the inner walls of the container tended to damage products contained therein and interfered with the loading and unloading thereof. Secondly, it was found that, during stacking of a plurality of the containers, particularly when loaded with products, there was a tendency for the topmost container to hang-up on the container immediately below during stacking. Finally, for some uses, the previous structure lacked sufficient strength.

SUMMARY OF THE INVENTION

It is therefore an object of the present invention to overcome the above-mentioned problems of the prior art.

Another object of the present invention is to provide an improved container which has reduced tendencies to damage products contained therein and to interfere with the loading and unloading thereof.

Still another object of the present invention is to provide an improved nesting container having reduced tendencies of a plurality of nested containers to result in an unstable pile.

Another and further object of the present invention is to provide an improved nesting container which has reduced tendencies to damage products contained therein, to interfere with the loading and unloading thereof and to result in an unstable pile of containers when nested.

Yet another object of the present invention is to provide an improved stacking container which has reduced tendencies for a topmost container to hang-up on the container immediately below during stacking.

A further object of the present invention is to provide an improved nesting and stacking container which has reduced tendencies to damage products contained therein, to interfere with the loading and unloading thereof, to result in an unstable pile of containers when nested and for a topmost container to hang-up on the container immediately below during stacking.

Another object of the present invention is to provide an improved stacking container having added strength.

As previously indicated, in the use of the container of U.S. Pat. No. 4,102,453, it was found that there was a tendency for sharp edges on the inner walls of the container to damage products contained therein and to interfere with the loading and unloading thereof. This was particularly true when the container was used for delicate products, such as baked goods. In accordance with the present invention, these problems were solved by beveling or rounding the top inner edges of the lower wall structures of the container, which extend upwardly from the bottom of the container.

However, this beveling of the top inner edges of the lower wall structures, was found to create additional problems, when nesting a plurality of the containers, particularly in a high pile. Since the major support for the topmost container by the container immediately below, during nesting, was provided by the bottom of the lower wall structures of the topmost container resting on the top of the lower wall structures of the container immediately below, it was found that the lower wall structure of the topmost container had a tendency to slide off the beveled edges of the lower wall structures of the container immediately below, thus causing the topmost container to tilt with respect to the container immediately below. While this tilting was slight and almost imperceptible, between individual containers, the tilting became cumulative, in the same direction, as each additional container was nested, so that a pile of a plurality of the containers was extremely unstable. These problems have been solved, in accordance with the present invention, by providing a plurality of support cleats on the bottom of at least one of the upper rail structures of the container, thereby providing support for the topmost container by the cleats of the upper rail structures of the topmost container resting on the top of the upper rail structures of the container immediately below. The use of such cleats has the additional advantage of providing positive contact between the respective upper rail structures regardless of slight undulations on the tops or bottoms of the upper rail structures, which might result during manufacture or use of the containers.

Also, as previously indicated, when the container of U.S. Pat. No. 4,102,453 was provided with rear lower wall structures and upper rail structures, it was found that there was a tendency for the topmost container to hang-up on the container immediately below during stacking of the containers in a high stack. In accordance with the present invention, this problem was solved by providing a runner means projecting forwardly from the bottom flange portion of the lower rear wall structure of the container.

Finally, the container of U.S. Pat. No. 4,102,453 was found to lack sufficient strength for certain uses, particularly at the rear corners. This problem is solved, in accordance with the present invention, by providing essentially solid side wall and rear wall structures.

Accordingly, one embodiment of the present invention comprises: a container of integrally molded construction having a generally-rectangular, horizontal bottom and opposed first and second side walls projecting upwardly from the bottom, each of the walls comprising: a lower wall member perpendicular to and extending upwardly from the bottom and having its inner top edge beveled; an upper rail member located above the lower wall, spaced vertically therefrom, parallel therewith, located in a vertical plane outside the outer surface of the lower wall and having a plurality of support cleat means extending downwardly from the bottom of the upper rail; a plurality of bar members connecting the lower wall with the upper rail; all of the bars being located in a vertical plane inside the vertical plane of the upper rail member, parallel to the upper rail and outside the vertical plane of the lower wall and the bars, in their plane, being inclined in the same direction, at the same angle and spaced one from the other a distance at least equal to the width of the bars; a stacking foot on the bottom of each bar; and a stacking saddle on the top of each bar; each stacking saddle being adapted to receive a stacking foot; the angle of inclination of the bars being such that the stacking foot of one bar is directly in vertical line with the stacking saddle of an adjacent bar which is inclined toward the previously-mentioned one bar, whereby an upper container will stack vertically on a like-oriented lower container with the stacking saddles of the lower container receiving the stacking feet of the upper container, and will nest with the lower container without relative rotation of the container, when the bars of the upper container are positioned between the bars of the lower container and the cleat means of the upper rail of the upper container rest on the top of the like upper rail of the lower container. In another embodiment of the invention, the container is provided with an end wall structure comprising: a lower end wall, an upper end rail, connecting bars, relatively located and connected in the same manner as the opposed side walls, a flange portion extending downwardly from the lower rear and side walls and a runner means projecting inwardly from the flange portion of the rear lower wall and having a glide surface flush with the bottom of the flange portion of the lower end wall.

DESCRIPTION OF THE PREFERRED EMBODIMENTS

Figure 1:
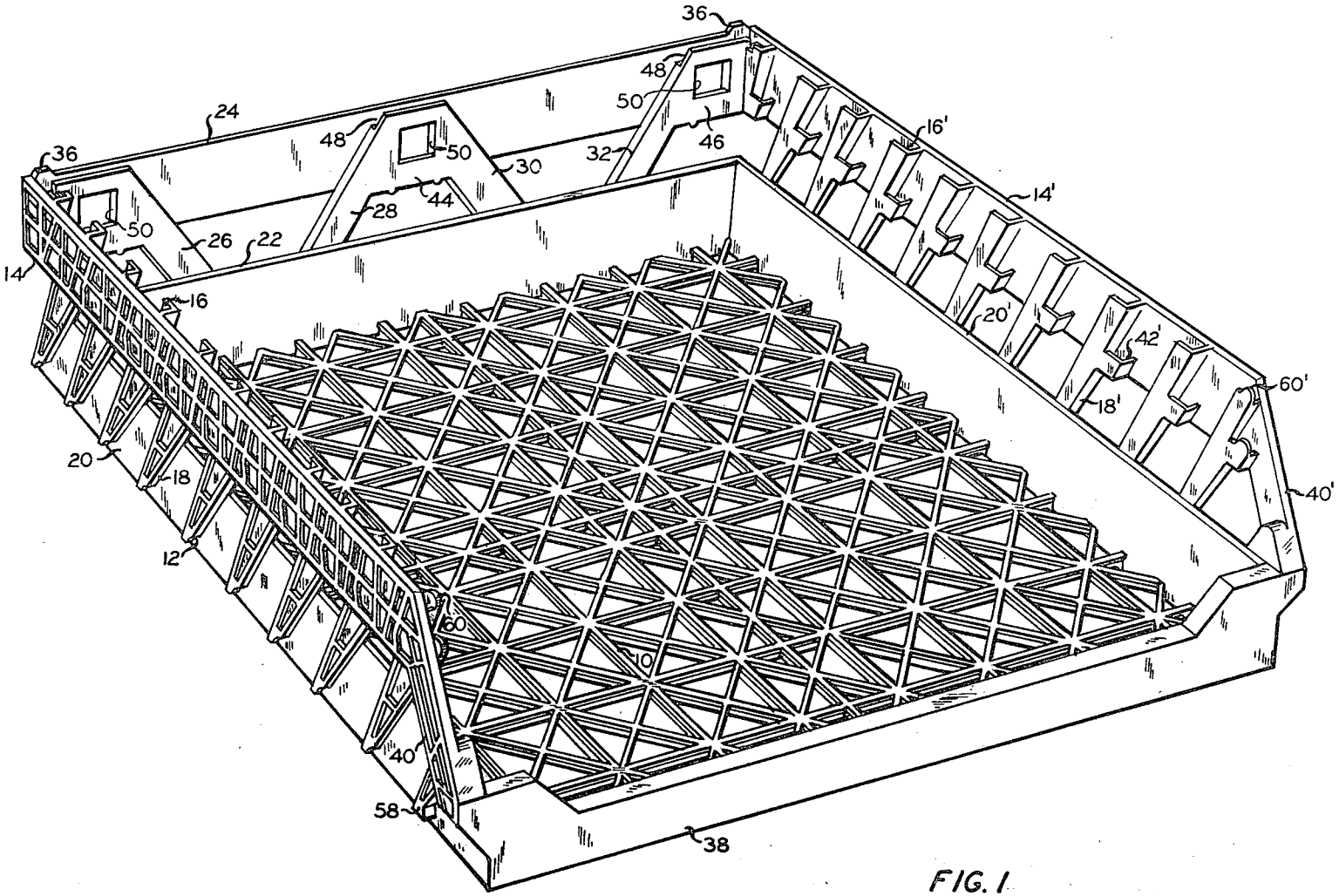
FIG. 1 is a top perspective view of one presently preferred container in accordance with the invention.
Figure 2:
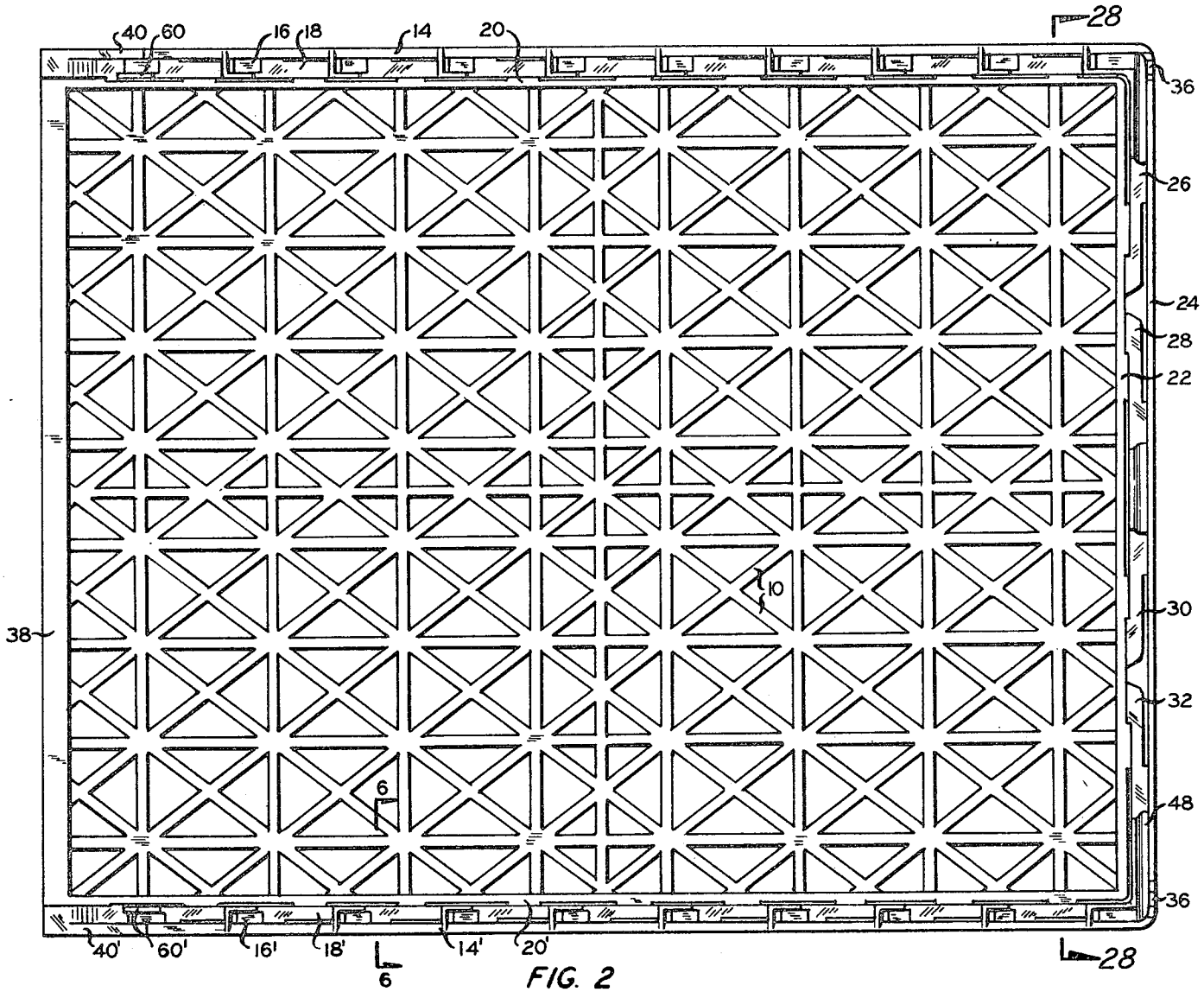
FIG. 2 is a top plan view of the container in FIG. 1.
Figure 3:
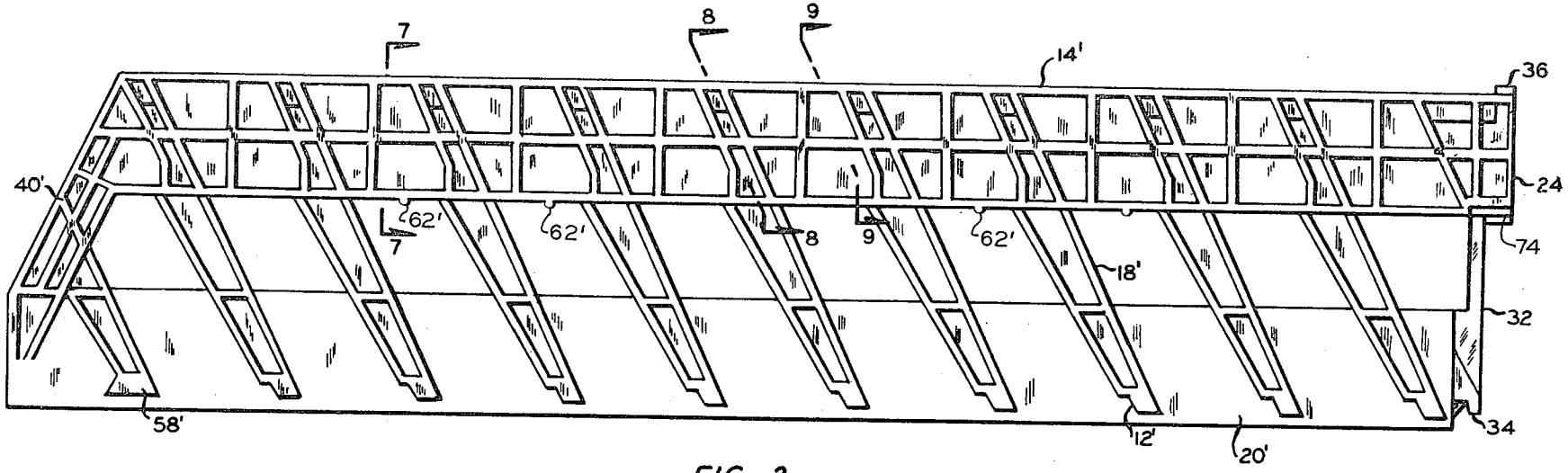
FIG. 3 is a side view in elevation of the container of FIG. 1.
Figure 4:
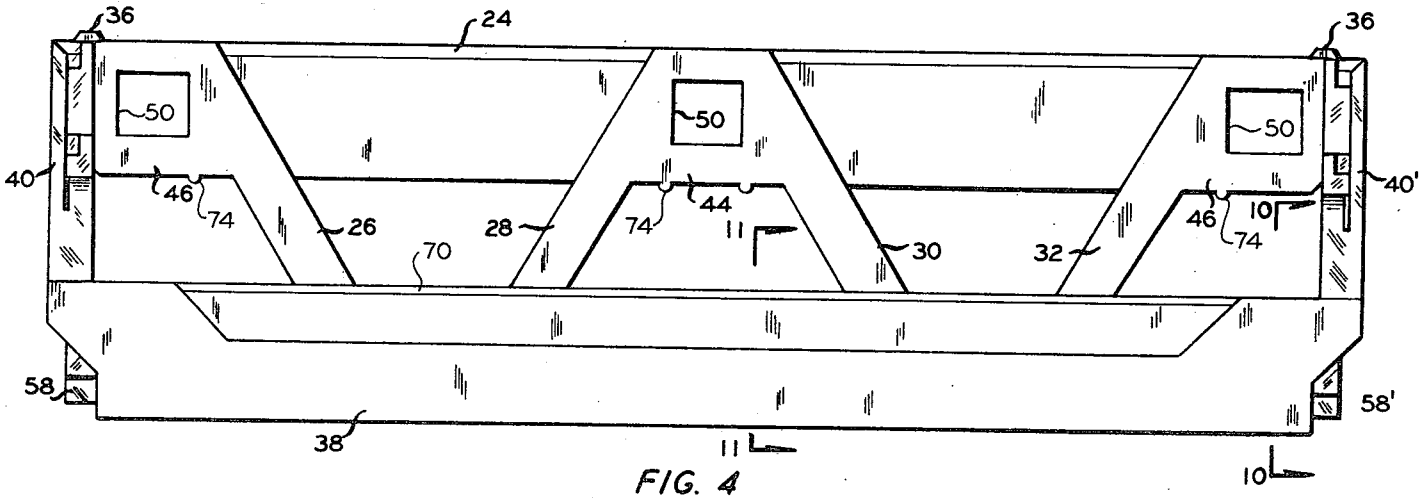
FIG. 4 is an end view in elevation of the open or front end of the container of FIG. 1.

Referring now to the drawings, wherein like reference numerals are employed to denote like elements, the invention will be more fully explained. In FIGS. 1 through 22 and 28 through 30, the container illustrated comprises, in one embodiment, a generally-horizontally-disposed bottom, and opposed first and second wall structures projecting upwardly from opposed first and second sides of said bottom. Preferably, said bottom will comprise a suitable gridwork, here generally denoted by the reference numeral 10. However, said bottom can comprise any other suitable bottom means such as a planar sheet, a perforated planar sheet, etc.

Each of said first and second wall structures includes the following:

A plurality of spaced apart stacking feet 12 or 12' disposed on a said side of said bottom. An upper rail member 14 or 14' spaced from and disposed generally-vertically above said side of said bottom. As illustrated in FIGS. 3, 7, 8, 9 and 23, the bottom of the upper rail 14 or 14' is provided with a plurality of support cleat means 62 or 62' adapted to facilitate nesting of a plurality of containers, as will be explained hereinafter. A plurality of spaced-apart stacking saddles 16 or 16' are disposed on the inner surface of said upper rail member and are in vertical alignment with said stacking feet. A plurality of spaced-apart and like-inclined bar members 18 or 18' extend upwardly, in one direction, between said side of said bottom and the inner surface of said upper rail members 14 and 14', respectively. Said stacking feet, said stacking saddles, and said inclined bar members, in each said wall structure, are so arranged with respect to each other that a like-oriented, upper container will (a) vertically stack on a lower container of like construction when at least some of the stacking feet of said upper container are in vertical alignment with, and in register with, at least some of the stacking saddles in the corresponding wall structure of said lower container, and (b) vertically nest within said lower container when said upper container is moved diagonally downward into said lower container to place said bar members of said upper container parallel to said bar members in the corresponding wall structure of said lower container, with the stacking feet of the upper container out of register with the stacking saddles of said lower container. A lower side wall 20 or 20' extends along a said side of said bottom 10 in a first vertical plane which is located adjacent and perpendicular to said side of said bottom. The lower wall member 20 or 20′ extends downwardly beyond the bottom 10 of the container to form a lip or flange portion 64 or 64′. (See FIGS. 10, 11, 12 and 29). In accordance with the present invention, lower side wall 20 or 20′ has its inside upper edge 66 or 66′ beveled. (See FIGS. 10, 11, 28 and 29). This rounding or beveling prevents damage to products deposited in the container or being loaded or unloaded and also facilitates loading and unloading of the container, particularly when the container is used for delicate products, such as bakery goods. Preferably, said stacking feet 12 or 12′ are disposed on the outer surface of said lower side wall 20 or 20′ in a second vertical plane which is located outside and adjacent said first vertical plane. Said upper rail member 14 or 14′ is disposed in a third vertical plane which is located outside and adjacent said second vertical plane of said stacking feet 12 or 12′. Said stacking saddles 16 or 16′ are thus disposed on the inner surface of said upper rail member 14 or 14′ in said second vertical plane and in vertical alignment with said stacking feet. Said inclined bar members 18 or 18′, which extend between the outer surface of said lower side wall and the inner surface of said upper rail, are thus located in said second vertical plane. Preferably, the lower end of each of said bar members 18 or 18′ comprises a said stacking foot 12 or 12′, and the upper end of each of said bar members comprises a said stacking saddle 16 or 16′.

The number and spacing of said stacking feet, said stacking saddles, and said inclined bar members in said first and second wall structures is not critical. All that is required is that said feet and said saddles, in a given container, be vertically aligned and that said bar members be like inclined in one direction only, i.e., all inclined in the same single direction and at substantially the same angle. When these requirements are met said feet, said saddles, and said bar members in each said wall structure can readily be so arranged that (a) a like-oriented, upper container will vertically stack on a lower container of like construction when at least some of the stacking feet of said upper container area are in vertical alignment with and in register with at least some of the stacking saddles in the corresponding wall structure of said lower container (see FIGS. 13*a*, 16, 18, 25, 26*b* and 26*c*) and (b) said upper container will vertically nest within said lower container when said upper container is moved diagonally downward into said lower container to place said bar members of said upper container parallel to said bar members in the corresponding wall structure of said lower container, with said stacking feet of the upper container out of register with the stacking saddles of said lower container. (See FIGS. 14, 24, 26*a*, 26*d* and 30).

FIGS. 24, 25, and 26*a* through 26*d* illustrate alternate arrangements of the stacking feet, the stacking saddles, and the inclined bar members in the first and second wall structures of containers in accordance with the invention. In said Figures the stacking feet are represented by x's and the stacking saddles are represented by u's . It is preferred that said feet and said saddles by symmetrically spaced, with some feet and some saddles at or adjacent the ends of the container, because this provides greater stability when a plurality of containers are stacked to considerable heights. However, it will be evident from this disclosure that considerable variation in the spacing of said feet and saddles is possible, and the containers will still stack and nest as described. From said Figures, it is evident that it is not essential that the stacking feet and stacking saddles be located on the ends of the inclined bars.

In presently preferred embodiments, the containers of the invention will also be provided with an end or rear wall structure which is positioned between and generally perpendicular to said first and second side wall structures. Said rear wall structure includes a lower rear wall 22 which extends along a third side of said bottom 10 in a corresponding first vertical plane which is located adjacent said third side of said bottom. The ends of said lower rear wall 22 are connected to adjacent ends of said lower side walls 20 and 20′ of said first and second side wall structures, respectively. Lower end wall 22 extends downwardly beyond the bottom 10 of the container to form a lip or flange portion 68. (See FIGS. 6 and 28). In the same manner as lower side wall 20 or 20′, lower end wall 22 has an inside upper beveled edge 70. (See FIGS. 4, 12, 28 and 29). Projecting inwardly from flange portion 68 of lower end wall 22 is runner means 72 (see FIGS. 28 and 29), whose bottom glide surface is flush with the bottom of flange portion 68. Runner means 72 facilitates stacking of one container on another, as will be explained in greater detail hereinafter. While it is within the scope of the present invention to provide more than one runner means, such as runner means 72, on the flange portion 68 of lower end wall 22, it is generally adequate to provide a single runner means adjacent the center of flange portion 68. An end or rear upper rail member 24 is disposed generally-vertically above said lower rear wall 22 in a corresponding third vertical plane, which is located outside and adjacent a corresponding second vertical plane which in turn is adjacent and outside said corresponding first vertical plane. Upper rear rail 24 is provided with a plurality of support cleat means 74. (See FIGS. 3, 4, 5, 12, 23, 28 and 29). As was the case with cleat means 62 and 62′ of upper side rails 14 and 14′, the cleat means 74 of an uppermost container rest on the top of an upper-rear rail 24 of a next lower container during nesting of a plurality of containers. It will be apparent from the discussion of the nesting of containers appearing hereinafter, that it is possible to provide a container with cleat means 74 on upper rear rail 24 only, cleat means 62 and 62′ on upper side rails 14 and 14′ or both. A plurality of spaced-apart inclined bar members, e.g., bar members 26, 28, 30 and 32, extend upwardly between the outer surface of said lower rear wall 22 and the inner surface of said upper rear rail member 24 and are disposed in said corresponding second vertical plane. The number, the spacing, and the inclination of the bar members in said third wall structure are not critical. All that is required is that the location, arrangement, and inclination of said bar members be such that an upper said container will nest within a like-oriented, lower container of like construction with said bar members of the upper container paralleling said bar members of the lower container. When an end or rear wall structure is provided, the inclined bar members of the first and second side wall structures must be inclined in a direction toward the front of the container, e.g., away from said rear wall structure, particularly when said rear wall structure is provided with stacking lugs and stacking ledges, and/or intermediate stacking supports, as described hereinafter.

Figure 5:
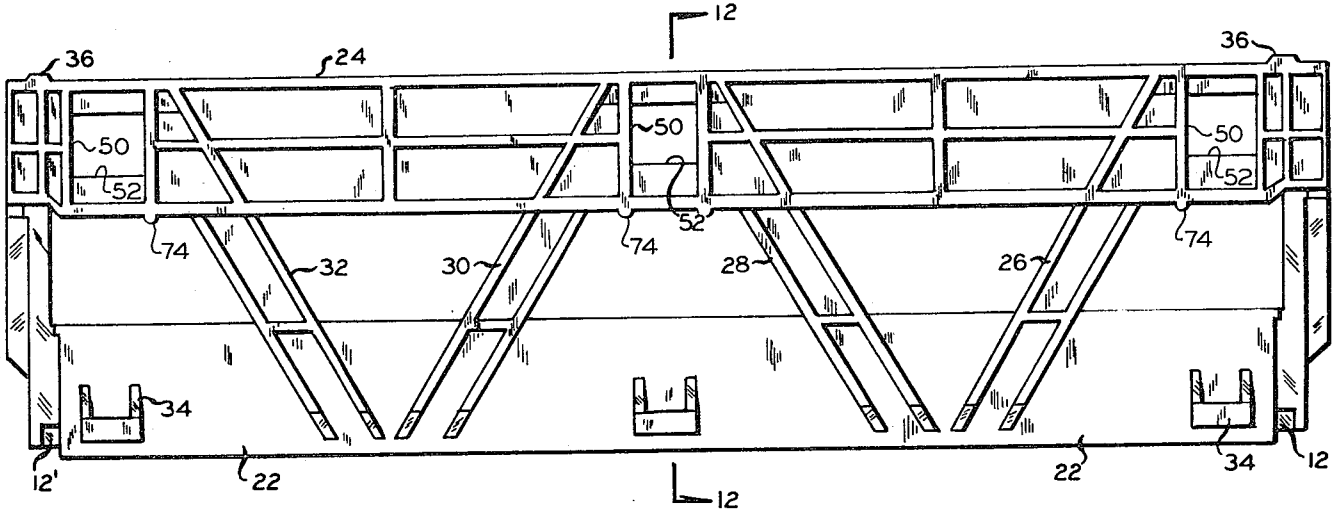
FIG. 5 is an end view in elevation of the closed or rear end of the container of FIG. 1.
Figure 6:
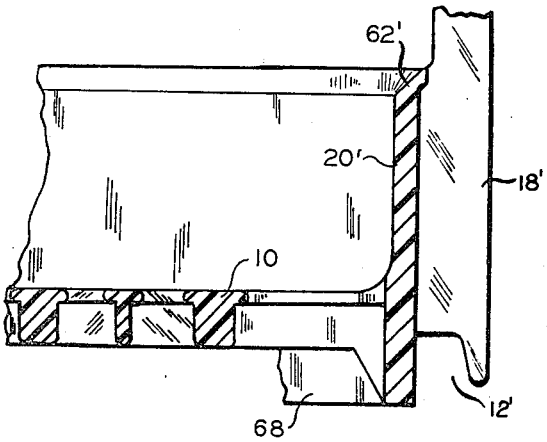
FIG. 6 is a cross section view taken along the lines 6—6 of FIG. 2.
Figure 7:
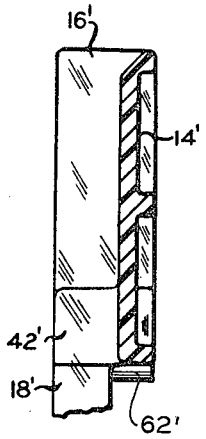
FIGS. 7, 8 and 9 are cross section views taken along the lines 7—7, 8—8, and 9—9, respectively, of FIG. 3.
Figure 8:
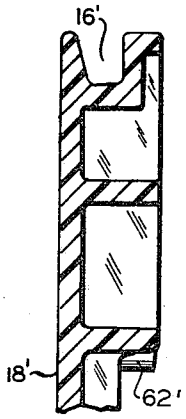
Figure 9:
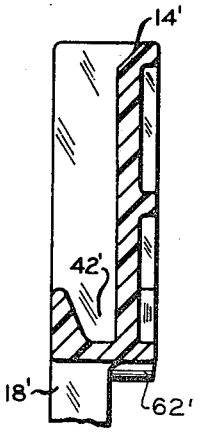
Figure 10:
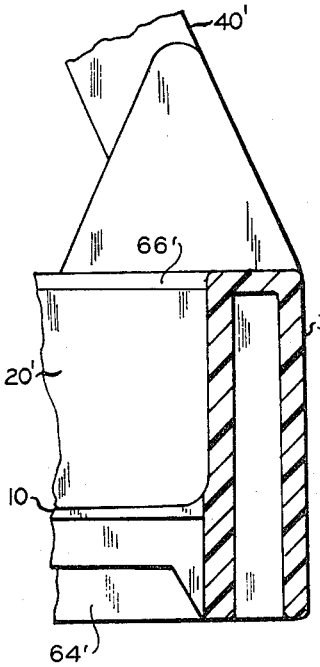
FIGS. 10 and 11 are cross section views taken along the lines 10—10 and 11—11, respectively, of FIG. 4.
Figure 11:
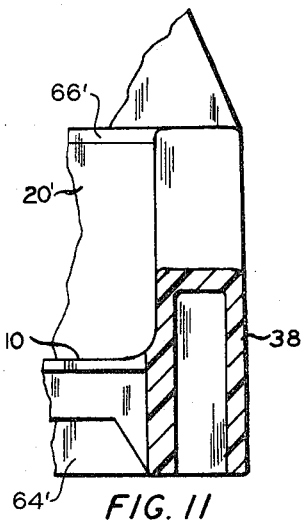
Figure 12:
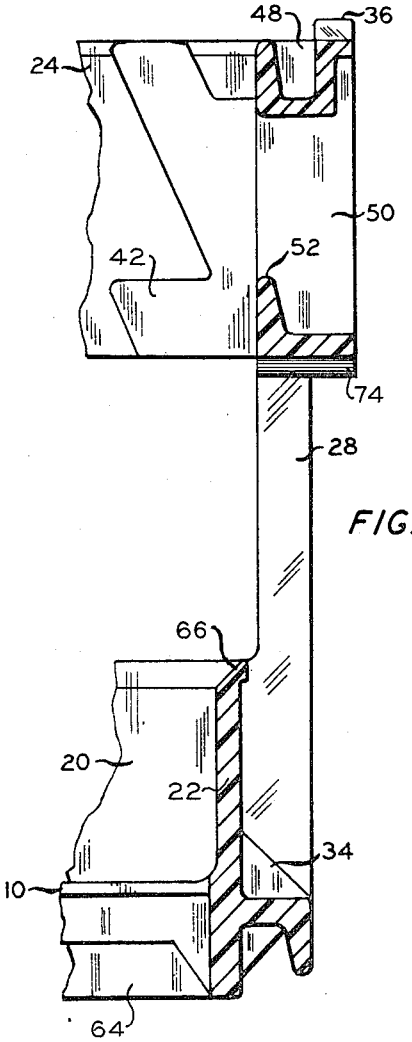
FIG. 12 is a cross section view taken along the line 12—12 of FIG. 5.

Referring now to FIG. 5, said rear wall structure will also preferably comprise a plurality of spaced-spart outwardly extending stacking lugs 34 which are disposed on the outer surface of said lower rear wall 22, in said corresponding second vertical plane, and at an elevation corresponding to the elevation of said stacking feet 12 and 12′ in said first and second side wall structures. Preferably, the bar members in said rear wall structure will be successively inclined in opposite directions to form alternating truncated V-forms and inverted truncated V-forms. A plurality of spaced-apart stacking ledges 48 (see FIGS. 1, 2, 12 and 29) are associated with the upper ends of said bar members on the inner surface of said third upper rail member 24, are disposed in said corresponding second vertical plane, in vertical alignment with said stacking lugs, and at an elevation corresponding to the elevation of said stacking saddles 16 and 16′ in said first and second wall structures, respectively.

In preferred embodiments of the invention, the containers will be provided with a front blind stacking means (see FIGS. 1, 2, 17, 18, 19 and 20). Thus, in each of said first and second side wall structures, the upper end of the forward stacking saddle, e.g., the upper end of the inclined bar member which is most removed from said third wall structure, is curved (as at 60 and 60′) and comprises one-half of a separable post and socket combination for guiding an upper container in one pre-stacking operation when said upper container is being stacked in a high-stack relationship on a like oriented lower container of like construction, as described further hereinafter. Similarly, in each of said first and second side wall structure, the upper inner surface of the stacking foot 58 or 58′, which is most removed from said rear wall structure, has a curvature corresponding to said curved upper end of said similarly located stacking saddle 60 or 60′ and comprises the other one-half of said post and socket combination.

In said preferred embodiments of the invention, the containers will also be provided with a rear blind stacking means. (See FIGS. 1, 12, 14–16, 23, 28 and 30). Thus, in each of said first and second wall structures, the side wall members 20 and 20′ project vertically above and below (flange portions 64 and 64′) the horizontal plane of the bottom panel 10 of the container. A pair of boss members 36 project upwardly from said rear upper rail member 24 at individual, spaced-apart positions, which are located in said second vertical plane and are adapted to coact with and guide the downwardly extending flange portions 64 and 64′ of lower side walls 20 and 20′ which in turn are located in said first vertical plane, in a pre-stacking operation described further hereinafter.

Preferably, the above-described containers of the invention will also be provided with a fourth lower end or front wall 38 which extends along a fourth side of said bottom 10, between and generally-perpendicular to said lower side walls 20 and 20′ in said first and second side wall structures, and projects vertically above the horizontal plane of said bottom 10 in a corresponding first vertical plane located adjacent said fourth side of said bottom. Preferably, the end portions of said lower front wall will project upwardly above said bottom 10 to a height which is the same as said lower side walls 20 and 20′, and the central portion of said lower front wall 38 will project upwardly to a height which is not more than about one-half the height of said lower side walls 20 and 20′. In these preferred embodiments of the invention, the upper side rail members 14 and 14′, in said first and second side wall structures, are each shorter in length than, and terminate inboard the ends of, the lower side walls 20 and 20′ therebelow. Preferably, an inclined brace member 40 or 40′ extends between each said shortened upper side rail member 14 or 14′ and said lower side walls 20 or 20′ located therebelow.

The structure of the stacking feet and the stacking saddles provided on the containers of the invention is not critical. Any suitable structures, e.g., substantially flat surfaces, can be employed for said stacking feet and said stacking saddles. However, the stacking saddles 16 and 16′ provided in said first and second side wall structures will preferably comprise a horizontal surface formed by providing a recessed socket in the upper end of said bar members 18 or 18′ on the side of said bar member which faces said rear wall structure. Similarly, each said stacking foot 12 or 12′ which is located at the lower end of one of said inclined bar members in said first and second side wall structures will comprise a downwardly extending post and a horizontal surface formed by providing a recess extending across the lower end of a said bar member on the side of said bar member which is adjacent the outer surface of the lower side wall 20 or 20′ to which said bar member is secured, with each said post being adapted to extend into a said socket of a stacking saddle. Preferably, each said stacking ledge 48 located on said rear upper rail member 24 will comprise an elevated crown and an associated recess formed on the tops of the bar members in said rear wall structure. Preferably, each said stacking lug 34 located on said rear lower wall 22 will comprise a downwardly-extending post and a horizontal surface formed by providing a recess extending across the bottom of said lug and will be adapted to coact with said elevated crown and its associated recess of said stacking ledges 48.

In the presently most preferred embodiments of the invention, the containers of the invention will also be provided with means for stacking an upper container within a like-oriented, lower container of like construction at an elevation intermediate the low level nesting position and the high-stack position. Said intermediate stacking means can preferably comprise a plurality of spaced-apart, intermediate stacking supports 42 or 42′ (see FIGS. 1, 7, 9, 12, 17, 18 and 29) disposed on one of (a) the inner surfaces of said upper side rail members 14 and 14′, or (b) the outer surfaces of said lower side walls 20 and 20′, at an elevation intermediate the elevations of, and in vertical alignment with, said stacking feet 12 and 12′ and said stacking saddles 16 and 16′, whereby an upper said container can be vertically stacked within a like-oriented lower container of like construction at said intermediate elevation, when at least some of the stacking feet 12 and 12′ of the upper container are in vertical alignment with, and in register with, at least some of said intermediate stacking supports 42 and 42′ in the corresponding wall structure of said lower container. Preferably, said intermediate stacking supports 42 and 42′ will ordinarily be disposed on the inner surfaces of said upper side rail members 14 and 14′.

When the containers of the invention are provided with a rear wall structure as described above, it is preferred that said rear wall structure also be provided with intermediate stacking supports 52 (see FIGS. 5, 12 and 29) for coacting with said stacking lugs 34. Preferably, the inclined bar members in said third wall structure are successively inclined in opposite directions to form alternating truncated V-forms and inverted truncated V-forms. For example, referring to FIGS. 1 and 5, said bar members 32–30 form a truncated V-form, said bar members 30–28 form an inverted truncated V-form, and said bar members 28–26 form a truncated V-form.

Preferably, a connecting member(s), such as member 44, is disposed on the inner surface of said third rear rail member 24 between and connecting the adjacent upper end portions of those said bar members forming an inverted V-form, e.g., bar members 28 and 30. Preferably, an extension member(s) 46 is disposed on the inner surface of said rear upper rail member 24, is connected to, and horizontally extends the upper end portions of those said bar members which do not form an inverted V-form, e.g., bar members 26 and 32. A plurality of spaced-apart stacking ledges 48 are formed on the upper edges of said connecting member 44 and said extension members 46, in vertical alignment with said stacking lugs 34 in said corresponding second vertical plane, and at an elevation corresponding to that of said stacking saddles 16 and 16' in said first and second wall structures. A plurality of openings 50, corresponding in number to said stacking lugs 34, are formed in and extend through said rear upper rail member 24. When said connecting member(s) 44 and said extension member(s) 46 are provided, said openings 50 also extend therethrough as illustrated. Said openings 50 are disposed in vertical alignment with said stacking lugs 34 in said corresponding second vertical plane. An intermediate stacking ledge 52 extends across the lower portion of each of said openings 50 at an intermediate elevation corresponding to the elevation of said intermediate stacking supports 42 and 42' in said first and second wall structures, whereby when an upper said container is vertically stacked at said intermediate elevation, within a like-oriented, lower container of like construction, said stacking lugs 34 extend into said openings 50 and are in register with said stacking ledges 52 therein.

Figure 23:
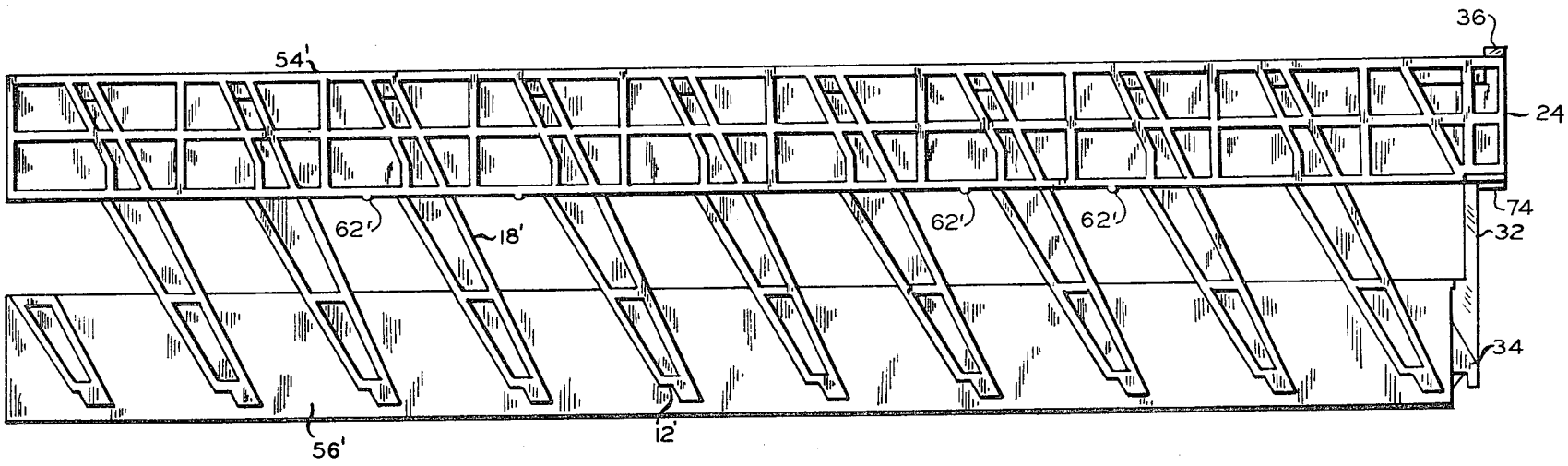
FIG. 23 is a side view in elevation illustrating a modification of the container of FIG. 1.
Figure 24:
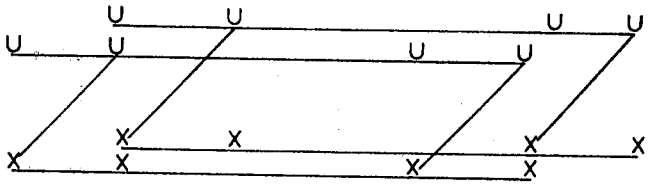
FIG. 24 is a diagrammatic side view illustrating two containers of the invention in another nesting relationship.
Figure 25:
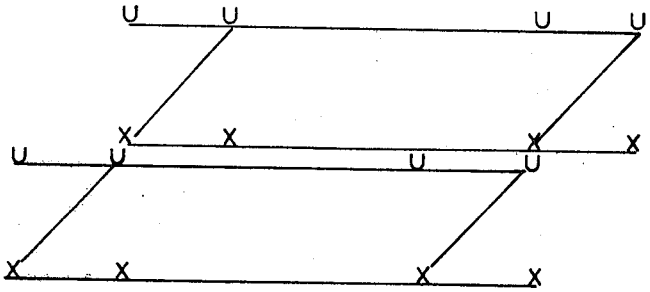
FIG. 25 is a diagrammatic side view illustrating two containers of the invention in another stacking relationship.
Figure 26:
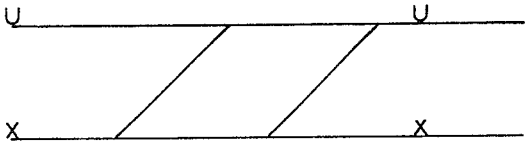
FIGS. 26, 26*a*, 26*b*, 26*c*, and 26*d* are diagrammatic side views illustrating alternate arrangements of the inclined bars, the stacking feet, and the stacking saddles in containers in accordance with the invention.
Figure 26A:
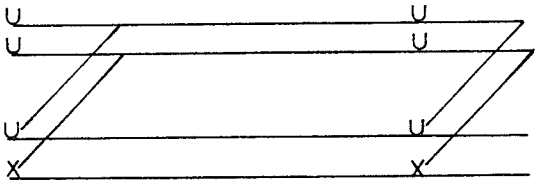
Figure 26B:
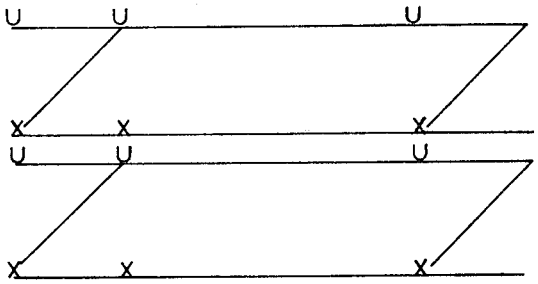

Referring now to FIG. 23, in the container there illustrated, the upper side rail members, e.g., side rail member 54', are of substantially the same length as the lower side walls, e.g., side wall 56', therebelow. In this embodiment of the invention, the inclined brace members 40 and 40' provided in the container of FIG. 1 are omitted. In all other respects, the container of FIG. 23 can be essentially like the container of FIG. 1.

FIGS. 14, 24, 26*a*, 26*d* and 30 illustrate nesting relationships of containers of the invention, e.g., the container illustrated in FIG. 1. As indicated, in the nesting operation, the upper container is moved diagonally downward into the lower container to place the bar members of the upper container parallel to the bar members in the corresponding wall structures of the lower container, with the stacking feet of the upper container out of register with the stacking saddles of the lower container. It will be evident from this disclosure that this nesting relationship can also be obtained with the container illustrated in FIG. 23. Said nesting relationship can be obtained when the containers of the invention are, or are not, provided with the above-described rear wall structure. For example, referring to FIG. 5, in the former case, it is evident that an upper container will fit into a lower container with the bar members in the rear wall structure of the upper container paralleling the corresponding bar members in the rear wall structure of the lower container. The depth or extent of the meeting of the upper container within the lower container can be varied by varying the vertical depth of the upper rail members, the spacing between the upper rail members and the lower wall members, and/or the height of the lower wall members above the bottom. It is usually preferred that the lower wall member of the containers extend vertically above the horizontal plane of the bottom panel to a height sufficient to provide from about one to about three inches clearance between the bottom panels of adjacent nested containers. This clearance is useful for low-profiled baked products. As indicated previously, when the containers are in a nested configuration, the support cleats 74 and/or 62 and 62' of the upper rails 24 and/or 20 and 20' of the uppermost container will rest on the top of the corresponding upper rails 24 and/or 20 and 20' of the container immediately below. In the case where only support cleats 74 are provided, the front of the upper container will be supported by the bottom of inclined brace members 40 and 40' and/or the bottom of lower front wall 38 of the uppermost container resting on the top of the inclined brace members 40 and 40' and/or the top of the lower front wall 38 of the container immediately below. To the extent that the container has no rear wall structure, only a partial rear wall structure similar to front wall structure 38, or no cleats 74 are provided, support cleats 62 and 62' of upper side rails 14 and 14' of the uppermost container will rest on the top of upper side rails 14 and 14' of the container immediately below. Where full side and rear wall structures and cleats 74 and 62 and 62' are provided said cleats 74, 62 and 62' of the uppermost container will rest on upper rails 24, 14 and 14', respectively, of the container immediately below and support said upper container.

The nesting relationship illustrated in FIGS. 14, 26*a*, 26*d* and 30 is referred to as vertical in-line nesting. In such nesting the upper rail members (and the lower wall members when present) of the upper container are vertically in-line with the corresponding members of the lower container. However, it is also within the scope of the invention to nest the containers of the invention in a vertical offset nested relationship when the containers are light duty containers and comprise only the above-described first and second side wall structures. This nesting relationship is illustrated diagrammatically in FIG. 24. Herein and in the claims, unless otherwise specified, the terms "vertically nest" or "nest vertically" are employed generically and include both said vertical in-line nesting and said vertical off-set nesting.

Figure 16:
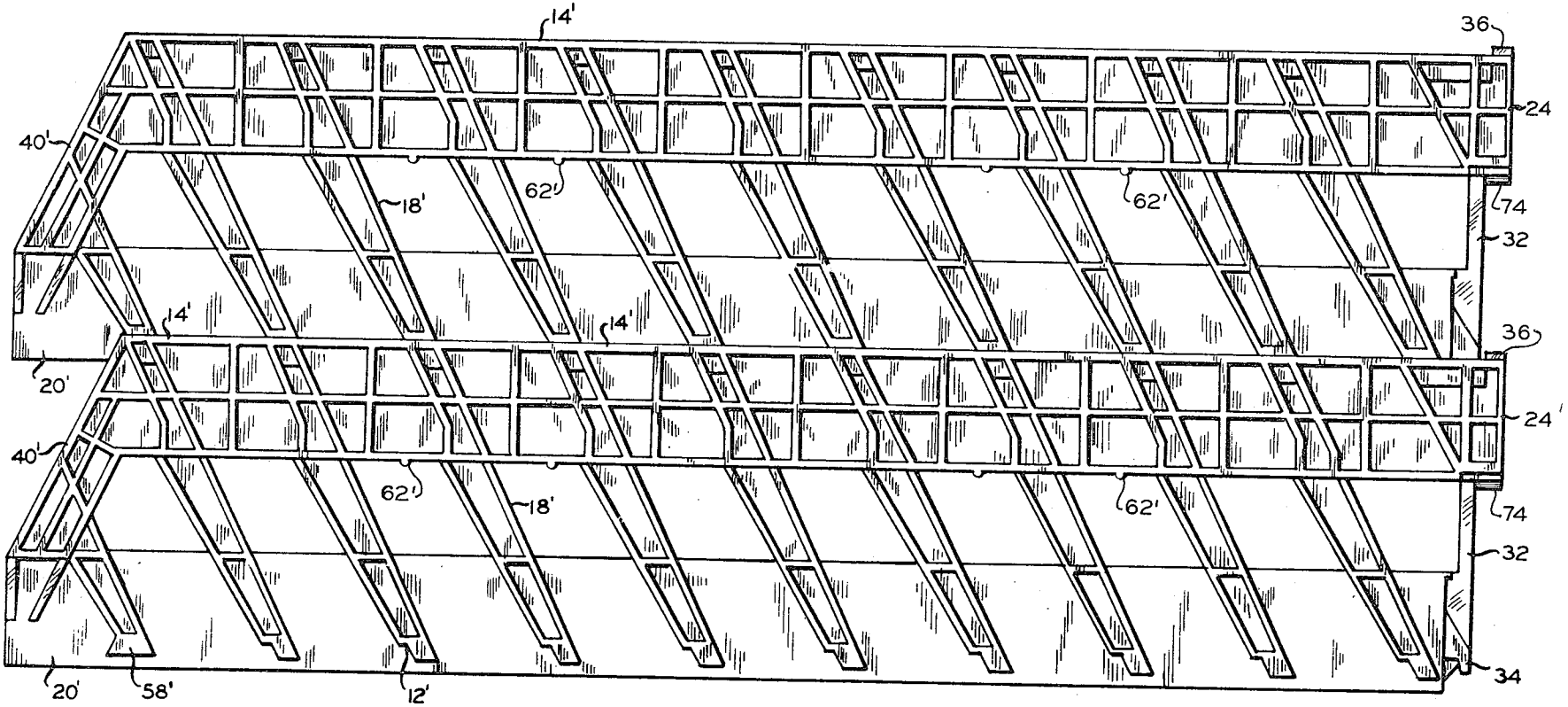
FIG. 16 is a side view in elevation showing two of the containers of FIG. 1 in a high-stack relationship.
Figure 18:
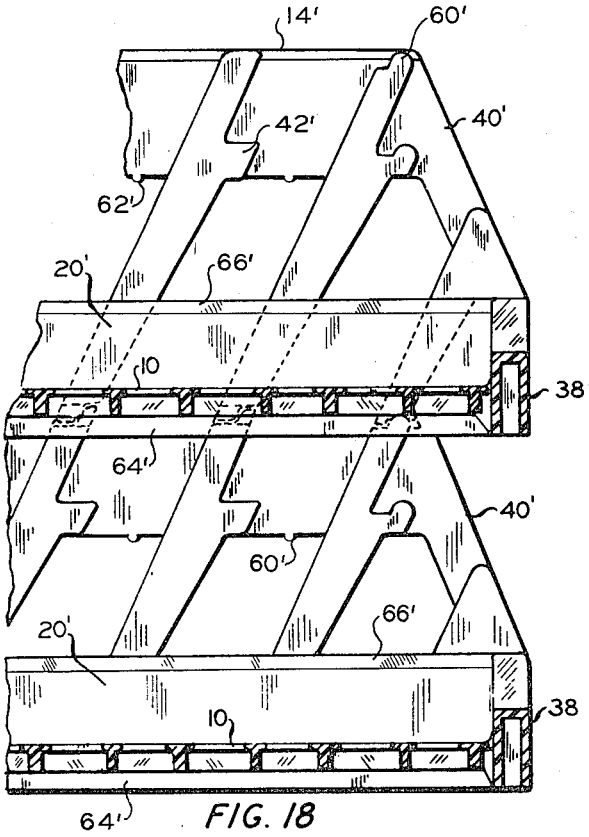
FIG. 18 is a partial side view in elevation (showing the other side of the wall structures in FIG. 16) and further illustrating two of the containers of FIG. 1 in a high-stack relationship.
Figure 19:
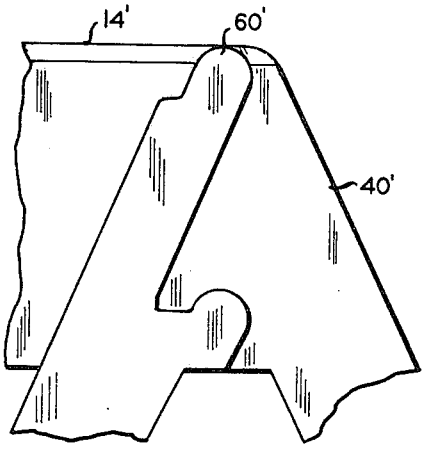
FIGS. 19, 20, 21, and 22 are enlarged detailed views, in elevation and/or cross section, illustrating details of one of the blind stacking means provided on the container of FIG. 1.
Figure 20:
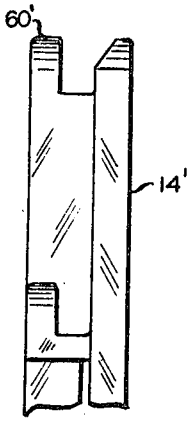
Figure 21:
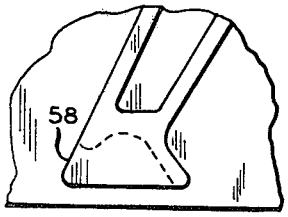
Figure 22:
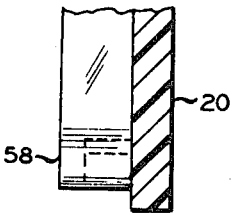

The stacking of containers of the invention, e.g., the container of FIG. 1, in a high-stack relationship is illustrated in FIGS. 13*a*, 16, 18, 25, 26*b* and 26*c*. In the high-stack relationship illustrated, the stacking feet 12 and 12' of the upper container are in vertical alignment with and in register with the stacking saddles 16 and 16' of a like-oriented, lower container of like construction. Thus, in the embodiment illustrated, the downwardly-extending posts of the stacking feet 12 and 12' extend into the sockets of stacking saddles 16 and 16' of said first and second side wall structures. In the rear wall structure provided at the rear of the container, the stacking lugs 34 on lower rear wall 22 are in vertical alignment with and in register with the stacking ledges 48 located on the inner surface of the rear upper rail members 24. Thus, the downwardly-extending posts of stacking lugs 34 extend into the recesses of the stacking ledges 48. The above-described interlocking relationship of the stacking feet and stacking saddles in the first and second side wall structures and the interlocking relationship between the stacking lugs and stacking ledges in the rear structure provide positive interlocks, which prevent either transverse or lateral movement of the stacked containers with respect to each other. Said positive interlocking also offsets any tendency for outward spreading of the walls of the lower containers (due to the weight of the upper containers) in a high-stack of loaded containers. It will also be noted that, in said high-stack relationship as illustrated in FIGS. 16 and 18, the lower edges of the lower wall members of the upper container, e.g., lower walls 20 and 20', are below and within the upper edges of the upper side rail members of the lower container, e.g., upper side rail members 14 and 14', thus providing further interlocking of the stacked containers.

It is clear from this disclosure that the above high-stack relationship can be obtained by placing an upper container vertically above a like-oriented lower container of like construction, and then lowering said upper container until the stacking feet thereof register with the stacking saddles of the lower container. However, the above-described rear blind stacking means and front blink stacking means are useful and advantageous when stacking containers of the invention in said high-stack relationship. As used herein and in the claims, unless otherwise specified, the "front" of the container is considered to be the open end of the container, i.e., the end where lower front wall 38 is located; and the "rear" of the container is the opposite end which is "closed" by the rear wall structure comprising lower rear wall 22 and upper rear rail member 24.

Said rear blind stacking means is particularly useful when a plurality of containers are being stacked to a relatively low height, e.g., below about shoulder height of the operator stacking the containers. For example, when is is desired to employ said rear blind stacking means 36, an upper container is placed above a like-oriented, lower container of like construction with the rear wall structure of said upper container disposed rearwardly of the rear wall structure of said lower container, and with the flange portions 64 and 64' of lower side walls 20 and 20' of said upper container resting on the rear upper rail member 24 of said lower container and inside said boss members 36 on said rear upper rail member 24. Preferably, the front of the lower container will be raised slightly from the horizontal. Then, lowering the front of the upper container to substantially horizontal position, and sliding the container forward, will cause said upper container to automatically drop into the high-stack relationship, when the lower rear wall 22 thereof has crossed the upper rear rail member 24 of said lower container. As previously indicated, in use, it has been found that there is a tendency for the uppermost container to hang-up on the container immediately below, when this stacking technique is employed. This can be due to slight undulations in the bottom of the rear lower wall 22 of the uppermost container, undulations in the top of the rear upper rail 24 of the lower container, nonuniformity of the bottoms of lugs 34 of the uppermost container, nonuniformity of the tops of stacking ledges 48 of the lower containers and/or simply tilting the forward portion of the uppermost container above an essentially horizontal plane when sliding the uppermost container forward. In any event, such hang-up is prevented by runner 72 of the uppermost container sliding across rear upper rail 24 and/or stacking ledge 48 of the lower container during forward movement of the uppermost container and until drop-in alignment has been attained. Thus, it is not necessary to meticulously align the stacking feet of the upper container and the stacking saddles of the lower container or to meticulously maintain the uppermost container in a horizontal plane prior to said sliding movement and automatic dropping into registration of the uppermost container.

Said front blind stacking means is particularly useful when a plurality of containers are being stacked to a relatively high height, e.g., above about shoulder height of the operator stacking the containers. For example, referring to FIGS. 1, 4, 16 and 19–22, when it is desired to employ said front blind stacking means, an upper container is lifted above a like-oriented, lower container of like construction and the forward stacking feet 58 and 58' having the upper, inner curved surface are placed over the curved-top posts 60 and 60' on the forward stacking saddles, with said upper container being held at a forwardly inclined angle with respect to said lower container. Then, lowering the rear portion of said upper container onto said lower container will cause the stacking feet and stacking lugs of said upper container to automatically register with the stacking saddles and the stacking ledges of said lower container in said high-stack relationship. Thus, it is not necessary to meticulously align the stacking feet of the upper container with the stacking saddles of the lower container prior to said automatic registration thereof.

Figure 13:
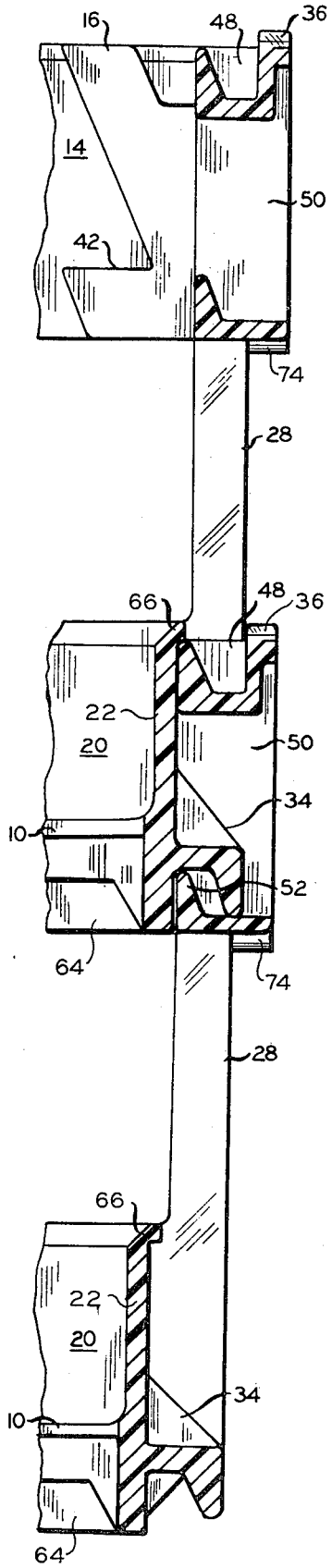
FIG. 13 is a cross section of two of the containers of FIG. 1 in an intermediate-stack relationship, and taken at a location corresponding to line 12—12 of FIG. 5.
Figure 13A:
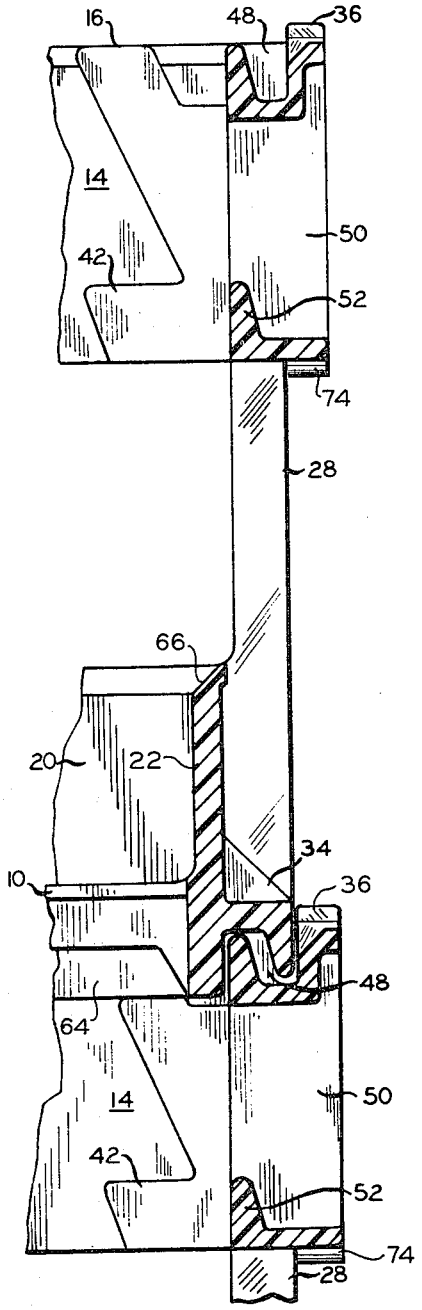
FIG. 13*a* is a cross section of two of the containers of FIG. 1 in a high-stack relationship, and taken at a location corresponding to line 12—12 of FIG. 5.
Figure 14:
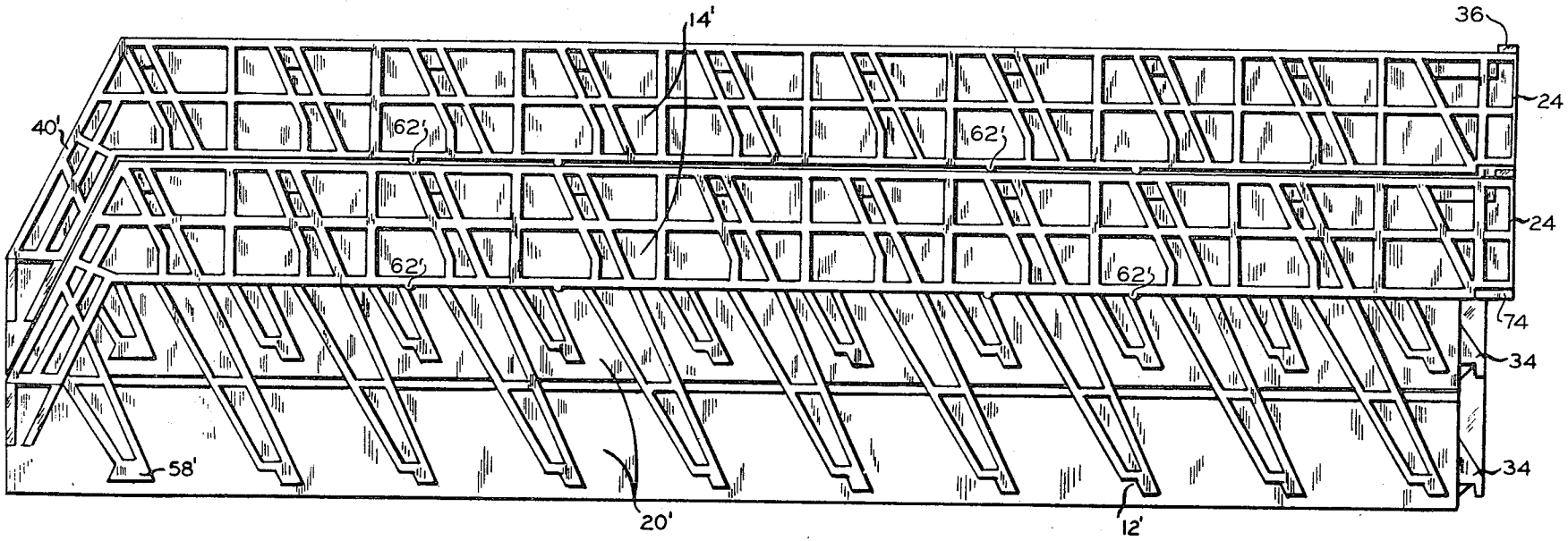
FIG. 14 is a side view in elevation showing two of the containers of FIG. 1 in a nested relationship.
Figure 15:
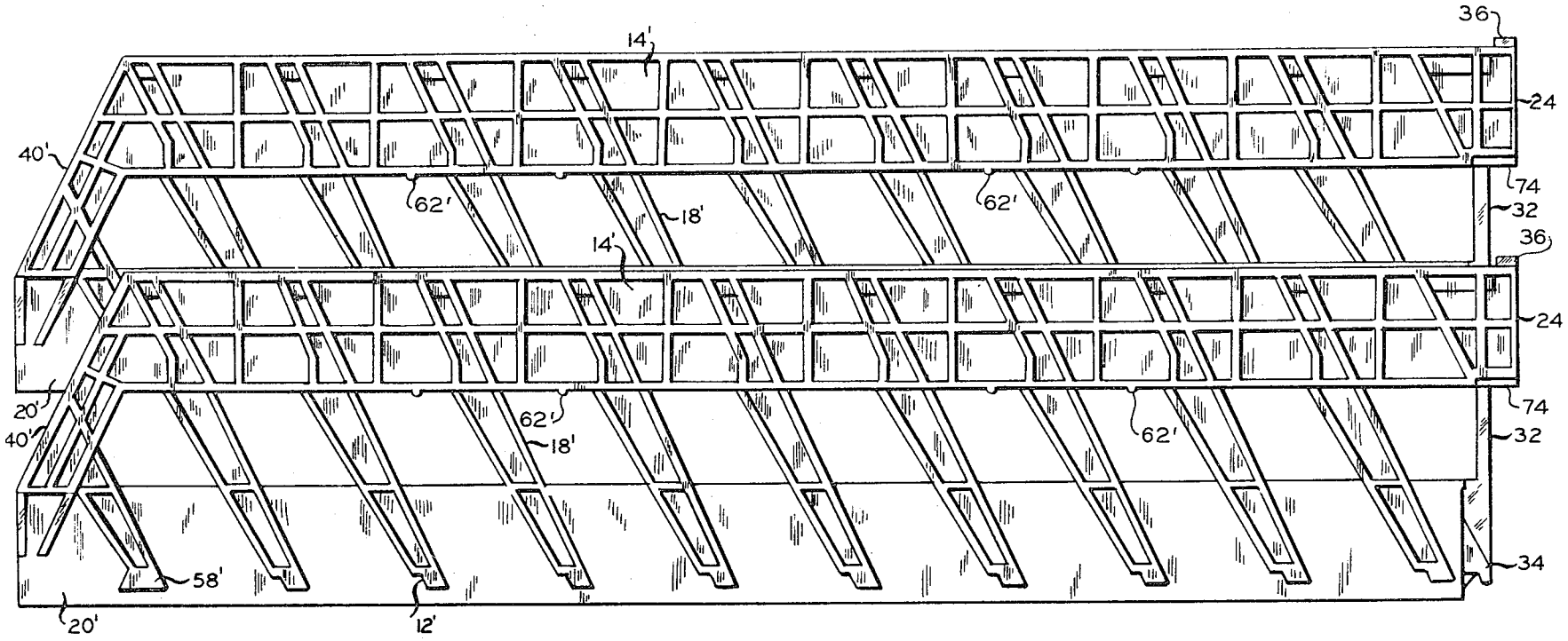
FIG. 15 is a side view in elevation showing two of the containers of FIG. 1 in an intermediate-stack relationship.
Figure 17:
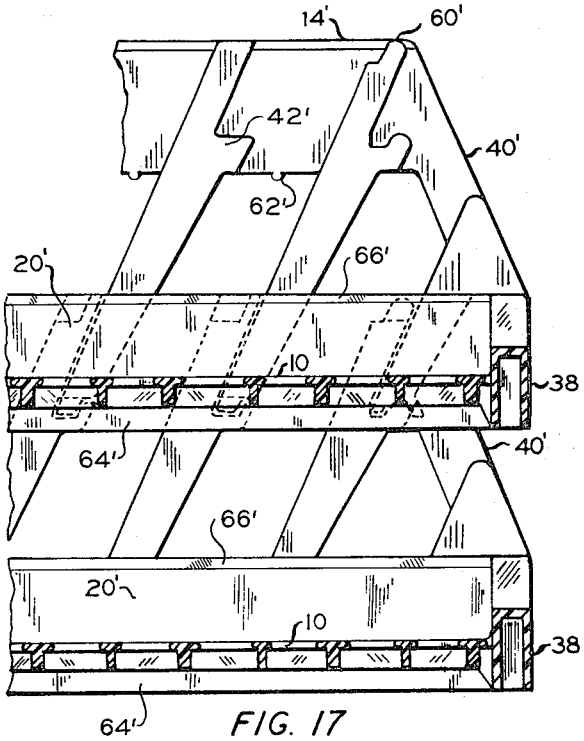
FIG. 17 is a partial side view in elevation (showing the other side of the wall structures shown in FIG. 15) and further illustrating two of the containers of FIG. 1 in an intermediate-stack relationship.

The stacking of containers of the invention in an intermediate-stacking relationship is illustrated in FIGS. 13, 15, and 17. In the intermediate-stacking relationship illustrated, the stacking feet 12 and 12' of the upper container are in vertical alignment with and in registration with the intermediate stacking supports 42 and 42', respectively, of a like-oriented, lower container of like construction. Thus, in the embodiment of the invention illustrated in FIGS. 1, 15, and 17 the downwardly-extending posts of stacking feet 12 and 12' extend into the sockets of intermediate stacking supports 42 and 42' in the first and second lower wall structures. In the rear wall structure, the stacking lugs 34 on the lower rear wall 22 are in vertical alignment with and in registration with the stacking ledges 52 which extend across the bottom of openings 50. Thus, there is obtained in the intermediate-stack position an interlocking between the stacked containers like that obtained in the above-described high-stack position.

In the container illustrated in FIGS. 1, 13, 15, and 17, said intermediate-stack position can be obtained by positioning an upper container above a like-oriented, lower container of like construction, and with the front of the upper container shifted slightly forward of the front of the lower container. The upper container is then lowered diagonally downward toward the rear of the lower container to bring the stacking feet and lugs of the upper container into registration with the intermediate stacking supports and ledges of the lower container.

When a said upper container is in the above described high-stack position on a said lower container, the upper container can be moved to either the above-described, intermediate-stack position or to the above-described, low nest position by lifting the upper container, then shifting the upper container slightly forward with respect to the lower container, and then lowering the upper container diagonally downward toward the rear of the lower container. The amount of said forward shifting will determine whether the upper container goes into the intermediate-stack position or into the low nest position.

The above described high-stack relationship illustrated in FIG. 16, and the above-described intermediate-stack relationship illustrated in FIG. 15, are referred to as vertical in-line stacking. In such stacking the upper rail members, and the lower wall members, when present, of the upper container are vertically in-line with the corresponding members of the lower container. However, it is also within the scope of the invention to high-stack, or intermediate-stack, containers of the invention in a vertical off-set relationship when the containers are light duty containers and comprise only the above described first and second side wall structures. This off-set relationship for the high-stack position is illustrated diagrammatically in FIG. 25. Thus, herein and in the claims, unless otherwise specified, the terms "vertically stack" or "stack vertically" are employed generically and include both said vertical in-line stacking and said vertical off-set stacking.

Figure 27:
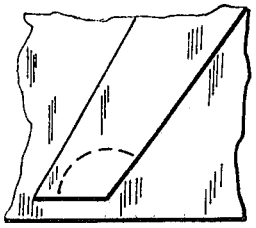
FIG. 27 is an enlarged detail view illustrating a modification of a forward stacking foot on the container of FIG. 1.
Figure 26C:
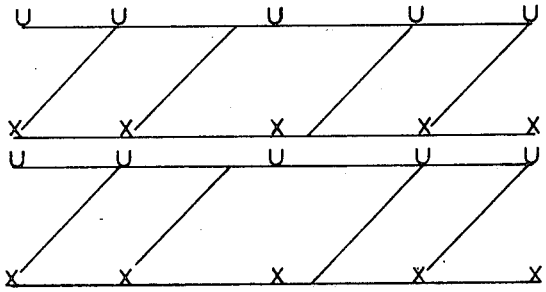
Figure 26D:
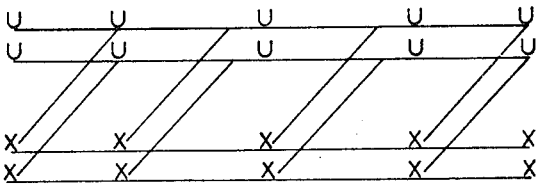
Figure 28:
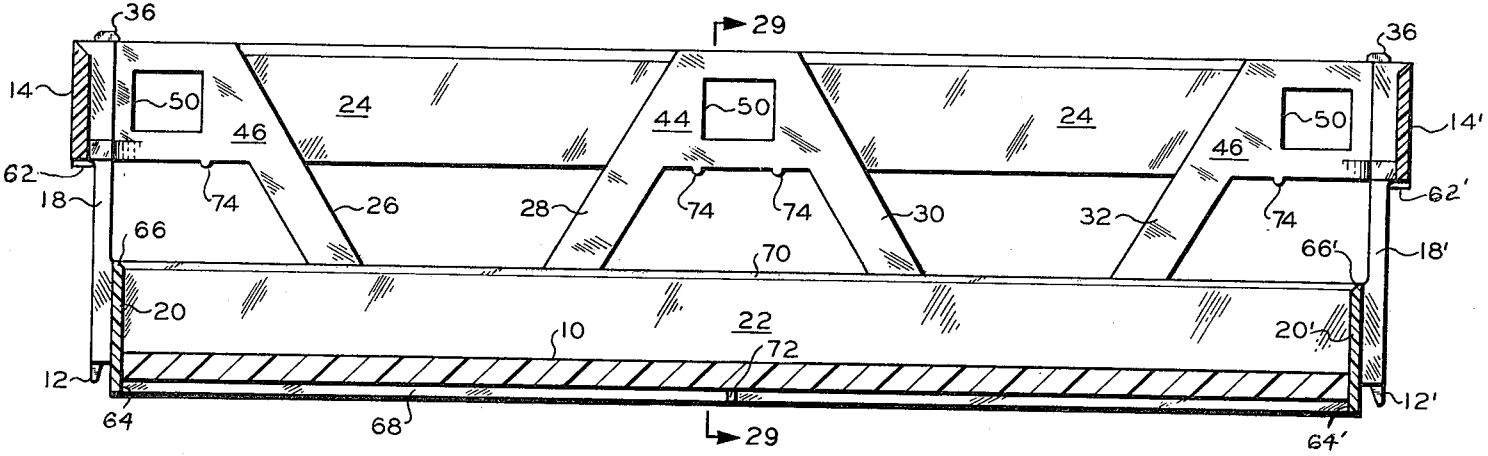
FIG. 28 is a cross-sectional view taken along the line 28—28 of FIG. 2.
Figure 29:
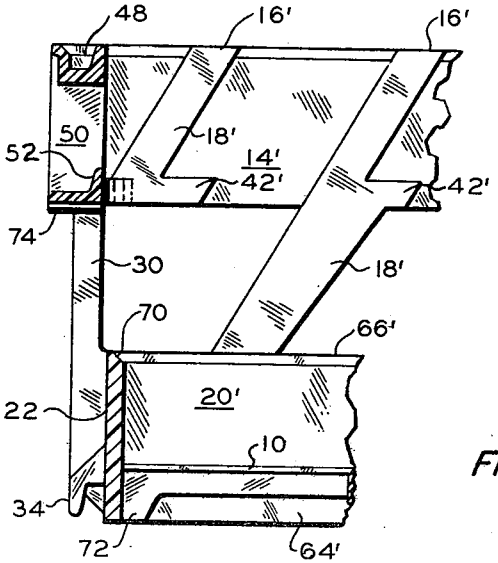
FIG. 29 is a cross-sectional view taken along the line 29—29 of FIG. 28.
Figure 30:
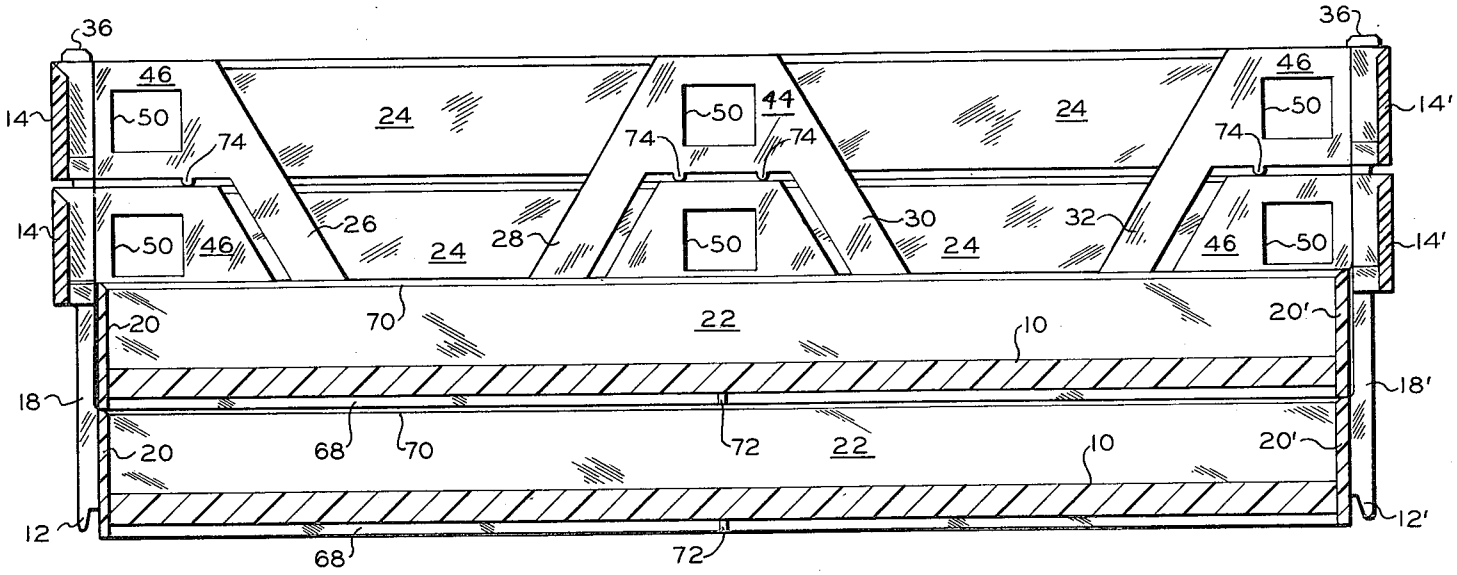
FIG. 30 is a cross-sectional view of two of the containers of the invention in a nested relationship, and taken at a location corresponding to line 28—28 of FIG. 2.

With minor modifications the containers of the invention can be stacked in said vertical off-set stacking position and canted with respect to the horizontal. The containers can be held in said canted position by any suitable support means (not shown) placed under the rear portion of the lower container, e.g., under the right hand end of the lower container in FIG. 25. Such an arrangement is useful for display purposes. The degree of off-set of the upper container will determine the amount of the lower container interior which is exposed for display. To obtain such an arrangement it is preferred that the forward stacking feet 58 (see FIG. 21) on the containers be modified. This modification can comprise removing a part of said forward stacking feet so that they will register in a compatible manner with the stacking saddles 16 and 16'. This modification is illustrated in FIG. 27 (compare with FIG. 21). When the containers to be placed in this canted relationship are provided with rear wall structures, a suitably located notch can be provided in the bottom of lower side walls 20 and 20' for registration with upper rear rail member 24 of the rear wall, if desired.

The above-described structures of the containers of the invention provide a number of advantages in the use of said containers. For example, the essentially vertical walls of the containers, wherein the various elements in the wall structures are in adjacent vertical planes, have greater vertical strength than the walls in those containers of the prior art which taper or diverge for nesting. This greater strength is obtained even though the wall structure of the containers of the invention comprises spaced-apart, inclined bar members. Said greater wall strength is valuable when loaded containers are stacked to considerable heights. The above-described interlocking relationship of the stacking feet and lugs with the stacking saddles and supports contributes to this increased wall strength. Furthermore, the spaced apart bar members reduce the weight of the container.

The fact that the containers of the invention are three-position containers which can be used at one height and then stacked at two additional heights, all without reotating an upper container with respect to a lower container, is a definite advantage over those containers of the prior art which must be rotated for stacking or nesting. As mentioned above, this three-position stacking or nesting increases the utility of the containers, making it unnecessary to have different containers for different products.

The walls of the container are substantially flat. This facilitates mechanical handling as on conveyor belts. The substantially-flat, outer surface of the upper rail members prevents interlocking of adjacent containers, such as can occur with containers of the prior art which are provided with convolutions, corrugations, etc. in the walls thereof. Said upper rail members also provide convenient handles for the containers without weakening the wall structure of the containers.

The containers of the invention can be fabricated in any suitable manner known to the art. Injection molding, for example, is one presently preferred method for fabricating said containers. Said containers can be fabricated from any suitable material. High density polyethylenes are especially desirable materials from which to fabricate said containers. The high density polyethylenes prepared by the methods disclosed and claimed by J. P. Hogan et al. in U.S. Pat. No. 2,825,721, issued Mar. 4, 1958, comprises one group of presently preferred materials. Said containers can also be fabricated from butadiene-styrene copolymers, and other plastic materials. If desired, a reinforcing fibrous material, such as asbestos or glass fibers, can be incorporated in the plastic material. While the various plastics are presently preferred for the manufacture of the containers, it is within the scope of the invention to fabricate said containers from other materials, e.g., lightweight metals such as aluminum, reinforced pulp materials, etc.

As an example, one model of a container fabricated in accordance with the invention had an overall length of about 25.50 inches, an overall width of about 23.50 inches, and an overall height of about 6.375 inches. Stacking lugs 34 had a width of about 1 inch. Inclined bar members 18 and 18' had an overall length of about 6.75 inches. Upper rail members 14 and 14' had a height of about 2.1 inches. Lower wall members 20 and 20' had a height of about 2.25 inches. The upper surface of the T-bars in the gridwork bottom was approximately ¼ inch. The dimensions of the other elements of the container were generally proportional in size.

It is obvious from the above description that the rear of the container can have a number of different forms. In one instance, there will be no rear wall structure. In another embodiment, the rear wall structure will include a lower wall member and an upper rail member, but the lower wall member can be only a partial lower wall having a structure such as that of the front wall. In yet another embodiment the rear wall structure, may include only an upper rail member of substantially the same structure as shown. In still another embodiment, the rear wall structure may include only a lower wall member, which can be of substantially the same structure as shown or a partial lower wall having a structure such as that of the front wall. In all of these instances, the containers will stack in several multi-position, in-line positions, as previously described. Another embodiment can include a rear wall structure in a single vertical plane and extending from the bottom to the height of the tops of the side rails. In this embodiment, the containers will stack in the high position in the in-line configuration, but, in the intermediate-stack position and the nesting position the upper container will be offset toward the front by a distance equal to the thickness of the rear wall. Of course, the rear wall can be a full or mesh type wall. In addition, with such a full or mesh-type closure for the rear wall, in-line intermediate stacking and nesting can be provided by offsetting the upper portion of the rear wall outwardly by a distance approximately equal to the thickness of the rear wall (the upper portion, if the upper and lower portions are of different thicknesses) and providing appropriate apertures 50 and stacking ledges 52 to receive the stacking lugs 34 in the intermediate and nest positions.

Figure 31:
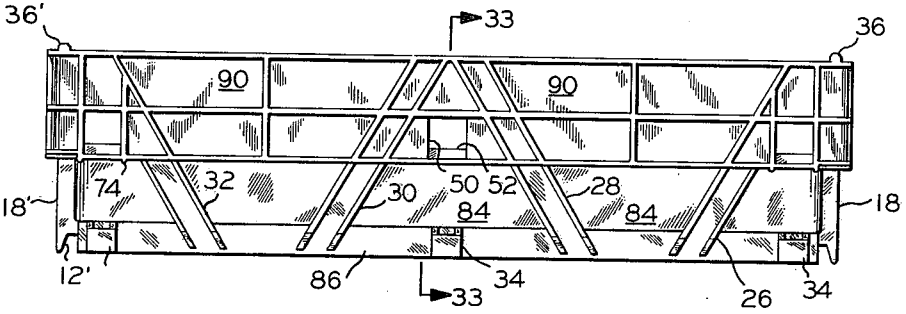
FIG. 31 is a rear end view of yet another embodiment of the present invention.
Figure 32:
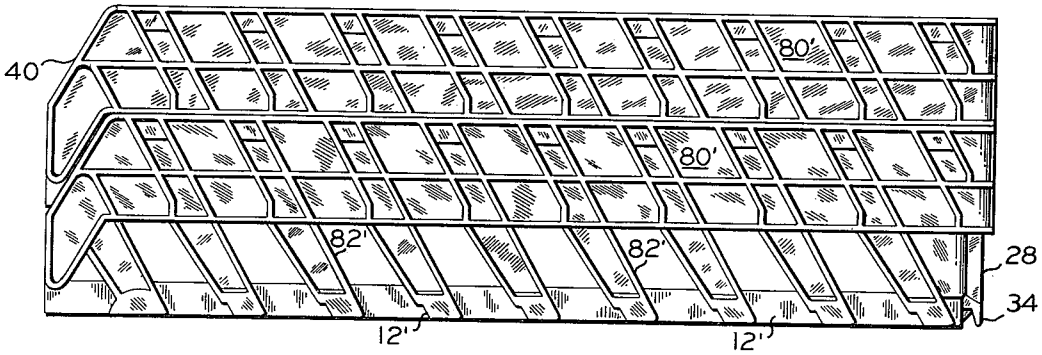
FIG. 32 is a right side view of two of the containers of FIG. 31 in their intermediate-stack or nested position.
Figure 33:
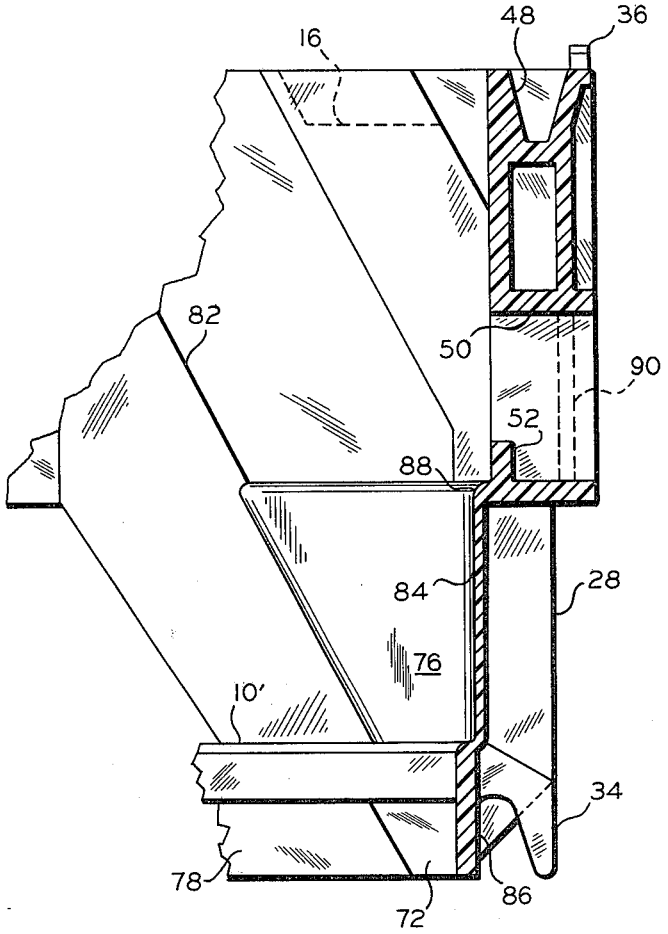
FIG. 33 is a cross-sectional view taken along the line 33—33 of FIG. 31.

Yet another embodiment, having side and rear wall structure of improved strength, is shown in FIGS. 31, 32 and 33.

In accordance with FIGS. 31, 32 and 33, each of the first and second side wall structures includes the following:

A partial lower side wall 76 or 76′ extends rearwardly from the rear most side bar 82 or 82′, along a side of the bottom 10 and in a first, vertical side plane which is located adjacent and perpendicular to the side of the bottom. A lip or flange portion 78 or 78′ extends downwardly beyond the bottom 10 of the container in the first, vertical side plane. Lower side wall 76 or 76′, preferably, has its inside, upper edge beveled, as previously discussed. An upper side rail 80 or 80′ extends upwardly from the top of the lower side wall 76 or 76′ and is spaced outwardly therefrom in a second vertical plane. The bottom of upper side rail 80 or 80′ may be provided with support cleats (62 or 62′, shown in previous Figures) but, as hereinafter pointed out, the preferred construction does not contain support cleats. A plurality of spaced-apart and like-inclined bar members 82 or 82′ extend upwardly in one direction, in a third vertical plane, between the outer surface of lower side wall 76 or 76′ and flange portion 78 or 78′ and the inner surface of the upper side rail 80 or 80′, and connect the lower side wall 76 or 76′ and the upper side rail 80 or 80′. A plurality of spaced-apart stacking saddles 16 or 16′ are disposed on the inner surface of the upper side rail 80 or 80′ or on the upper ends of the inclined bar members 82 or 82′, in the third, vertical plane. A plurality of cooperating, spaced-apart stacking feet 12 or 12′ are disposed on the outer flange portions 78 and 78′, the lower side wall 76 or 76′ or on the bottoms of inclined bar members 82 or 82′, in the third, vertical plane. Obviously, the lower side wall can extend upwardly to the bottom of the side rail 80 or 80′ along the full length of the side wall structure or any portion thereof.

An end or rear wall structure is positioned between the side wall structures, is generally perpendicular to the side wall structures and is attached to said side wall structures. Lower rear wall 84 extends along the rear of the bottom 10 in a first, vertical plane, is substantially the same height as lower side walls 76 and 76′ and has its ends connected to the rear ends of side walls 76 and 76′. The lower rear wall 84 extends downwardly below bottom 10 to form a lip or flange portion 86 and, preferably, has its inside, upper edge 88 beveled. An upper rear rail 90 extends upwardly from the top of lower rear wall 84 in a second, vertical plane outwardly offset from lower rear wall 84, is substantially the same height as the upper side rails 80 and 80′ and has its ends connected to the rear ends of upper side rails 80 and 80′. Support cleats (74, as shown in FIG. 31) may be provided on the bottom of upper rear rail 90 but, as will appear later, are not necessary. Preferably, runner 72 extends inwardly from the flange portion 86 of lower rear wall 84 and has its glide surface flush with the bottom of flange portion 86. A plurality of spaced-apart, inclined rear bar members, e.g., rear bar members 26, 28, 30 and 32, extend upwardly, in a third vertical plane between the outer surface of lower rear wall 84 and the inner surface of upper rear rail 90. Said bar members connect the lower rear wall 84 and the upper rear rail 90 in the same manner as discussed in the previous embodiments and are located, arranged and inclined in the same manner. Obviously, the rear wall 84 may have essentially the same structure as side walls 76 and 76′, with only end portions extending up to the rear rail and a bottom flange 86.

Spaced-apart stacking lugs 34 are disposed on the outer surface of lower rear wall 84, in the third, vertical plane, and cooperate with spaced-apart stacking ledges 52 formed on the inner, bottom edges of apertures 50 through upper rear rail 90, as previously described. Stacking ledges 48 are formed on the inner, upper edges of bar members 26, 28, 30 and 32, in the third, vertical plane, as previously described. Preferably, a pair of boss members 36 and 36′ project upwardly from upper rear rail 90 and serve the same guiding function previously discussed.

The container of FIGS. 31, 32 and 33 may be stacked on a like container in the high-stack position in the same manner as previously discussed.

The container of FIGS. 31, 32 and 33 may also be stacked in the intermediate-stack position. The stacking procedure is the same as that previously described. However, there are no intermediate stacking saddles and in the intermediate-stack position, as shown in FIG. 32, the bottoms of the upper side and rear rails of an upper container rest on the tops of the upper side and rear rails of a lower container. The relative heights of the lower side and rear walls and the upper side and rear rails, their spatial relationship and their greater strength permit such stacking and make the use of intermediate stacking saddles unnecessary. It is also to be noted, as is apparent, that this "intermediate-stack" position also becomes the nesting position in this embodiment. However, intermediate stacking saddles and ledges which cooperate with the stacking feet and lugs can be provided between these high-stack and low-stack positions.

Herein and in the claims, the word "rectangular" has been employed generically to include four-sided structures which are generally square and four-sided structures wherein one pair of sides is longer than the other pair of sides.

While reference has been made herein to first and second "side" wall structures, "side" walls, or "side" rails, a "rear" wall structure, "rear" wall or "rear" rail and a "front" wall structure, or "front" wall, it is to be recognized that these references are used only as a matter of convenience and to aid one in visualizing the general configuration of the container. However, these terms are meant to include a first and second wall structure, wall or rail, a third wall structure, wall or rail and a fourth wall structure or wall, respectively.

While certin embodiments of the invention have been described for illustrative purposes, the invention is not limited thereto. Various other modifications or embodiments of the invention will be apparent to those skilled in the art in view of this disclosure. Such modifications or embodiments are within the spirit and scope of the disclosure.

What is claimed is:

1. In a generally rectangular container, adapted to stack and to nest with an upper container of like construction, having opposed, vertical side walls and a vertical rear wall, comprising: lower side rails and a lower rear rail, respectively, all terminating at their bottoms in a single, horizontal bottom plane, all terminating at their tops in a single, horizontal intermediate lower plane, all having their inner upper edges beveled and all disposed in respective first vertical planes and upper side rails and an upper rear rail, respectively, all terminating at their bottoms in a single, horizontal intermediate upper plane, all terminating at their tops in a single, horizontal top plane and disposed in respective second vertical planes outwardly offset from said first vertical planes; a horizontally disposed bottom extending between and joined to said side walls and said rear wall between said bottom plane and said intermediate lower plane, thereby forming flange portions of said lower side rails and said lower rear rail, respectively, extending below said bottom; and upwardly projecting guide bosses formed adjacent the rear corners of said container and adapted to guide the bottoms of the side walls of said upper container of like construction therebetween during a forward, sliding movement of said upper container of like construction to a stacking position atop the container hereof, the improvement comprising: at least one runner means extending a short distance forwardly from said flange portion of said rear wall and terminating at its bottom at said bottom plane to provide a horizontal slide surface coincident with said bottom plane, the runner means of said upper container of like construction being adapted to slide along the top of said rear wall of said container hereof during said forward, sliding movement of said upper container of like construction to a stacking position atop said container hereof; and a plurality of downwardly projecting cleat means spaced along the bottom of at least the upper rear rail of said upper side rails and said upper rear rail, the cleat means of said upper container of like construction being adapted to rest on the top of said at least the upper rear rail of said upper side rails and said upper rear rail of said container hereof and be supported by said container hereof with the intermediate upper plane of said upper container of like construction substantially coincident with said intermediate lower plane of said container hereof when said upper container of like construction is nested with said container hereof.

2. A container in accordance with claim 1 wherein the guide bosses are formed on the top of the upper rear rail.

3. In a generally-rectangular container, adapted to stack with an upper container of like construction, having opposed, vertical side walls and a vertical rear wall terminating at their bottoms in a single, horizontal bottom plane and terminating at their tops in a single, horizontal top plane; a horizontally-disposed bottom extending between and joined to said side walls and said rear wall between said bottom plane and said top plane, thereby forming flange portions of said side walls and said rear wall, respectively, extending below said bottom; and upwardly projecting guide bosses formed adjacent the rear corners of said container and adapted to guide the bottoms of the side walls of said upper container of like construction therebetween during a forward, sliding movement of said upper container of like construction to a stacking position atop the container hereof, the improvement comprising: at least one runner means extending a short distance forwardly from said flange portion of said rear wall and terminating at its bottom at said bottom plane to provide a horizontal slide surface coincident with said bottom plane, the runner means of said upper container of like construction being adapted to slide along the top of said rear wall of said container hereof during said forward, sliding movement of said upper container of like construction to a stacking position atop said container hereof.

4. A container in accordance with claim 3 wherein the side walls and rear wall comprise lower side rails and a lower rear rail, respectively, disposed in respective first vertical planes and upper side rails and an upper rear rail, respectively, disposed in respective second vertical planes outwardly offset from said first vertical planes and the guide bosses are formed on the top of said upper rear rail.

5. A container in accordance with claim 4 wherein a plurality of engageable male stacking means and female stacking means, respectively, are spaced along each of the outer surfaces of the bottoms of the lower side rails and the lower rear rail and the inner surfaces of the upper side rails and the upper rear rail, respectively, terminate adjacent the bottom plane and the top plane, respectively, of said container and are adapted to engage when the upper container of like construction is positioned directly above the container hereof and to support said upper container of like construction atop the container hereof in a stacked position.

6. A container in accordance with claim 5 wherein the male stacking means or the female stacking means, respectively, spaced along the upper rear rail are female stacking means formed, as longitudinally-oriented, slot-like depressions with generally-parallel walls and said upper rear rail forms one of said generally-parallel walls of said slot-like depressions.

7. A container in accordance with claim 1 or 2 wherein a plurality of engageable male stacking means and female stacking means, respectively, are spaced along each of the outer surfaces of the bottoms of the lower side rails and the lower rear rail and the inner surfaces of the upper side rails and the upper rear rail, respectively, terminate adjacent the bottom plane and the top plane, respectively, of said container and are adapted to engage when the upper container of like construction is positioned directly above the container hereof and to support said upper container of like construction atop the container hereof in a stacked position.

8. A container in accordance with claim 7 wherein the male stacking means or the female stacking means, respectively, spaced along the upper rear rail are female stacking means formed as longitudinally-oriented, slot-like depressions with generally-parallel walls and said upper rear rail forms one of said generally-parallel walls of said slot-like depressions.

9. In a generally-rectangular container, adapted to nest with an upper container of like construction, having opposed, vertical side walls and a vertical rear wall, comprising: lower side rails and a lower rear rail, respectively, all terminating at their bottoms in a single horizontal bottom plane, all terminating at their tops in a single, horizontal intermediate lower plane, all having their inner upper edges beveled and disposed in respective first vertical planes, and upper side rails and an upper rear rail, respectively, all terminating at their bottoms in a single horizontal intermediate upper plane, all terminating at their tops in a single horizontal top plane and disposed in respective second vertical planes outwardly offset from said first vertical planes, the improvement comprising: a plurality of downwardly projecting cleat means spaced along the bottom of at least the upper rear rail of said upper side rails and said upper rear rail, the cleat means of said upper container of like construction being adapted to rest on the top of said at least the upper rear rail of said upper side rails and said upper rear rail of the container hereof and be supported by said container hereof with the intermediate upper plane of said upper container of like construction substantially coincident with said intermediate lower plane of said container hereof when said upper container of like construction is nested with said container hereof.

10. A container in accordance with claim 1 or 9 wherein a plurality of longitudinally-oriented, slot-like depressions with generally-parallel walls are spaced along at least the upper rear rail, said upper rear rail forms one of said generally-parallel walls of said slot-like depressions, and the cleat means are adapted to extend transversely across said slot-like depressions and said generally-parallel walls of said slot-like depressions.

11. A container in accordance with claim 1 or 9 wherein the cleat means are spaced along the bottoms of the upper rear rail and the upper side rails.

12. A container in accordance with claim 1 or 9 wherein the cleat means are spaced along the bottom of the upper rear rail only, the container includes a front wall attached to the bottom of said container, having a top extending up to the lower intermediate plane at least adjacent the front corners of said container, and having a bottom terminating at said bottom plane, and the bottom of the front wall of the upper container of like construction rests atop said top of said front wall of said container hereof and said upper container of like construction is supported by said container hereof when said upper container of like construction is nested with said container hereof.

13. A container in accordance with claim 1 or 9 wherein the upper side rails and the upper rear rail, respectively, are spaced from the lower side rails and the lower rear rails respectively, said upper side rails and said upper rear rail and said lower side rails and said lower rear rail are joined by spaced apart bar members and reinforcing wall portions are formed in at least one of the spaces between the lower side rails and the upper side rails and the rearmost support members and the rear corners of said container or between the lower rear rail and the upper rear rail and the outermost bar members and the rear corners of said container or both.

14. A container in accordance with claim 13 wherein the support wall means is formed in both the space between the lower side rails and the upper side rails and the rearmost support bar and the rear corners of the container and between the lower rear rail and the upper rear rail and the outermost support bars and the rear corners of the container.

* * * * *